US006441544B1

(12) United States Patent
Ando et al.

(10) Patent No.: US 6,441,544 B1
(45) **Date of Patent: *Aug. 27, 2002**

(54) ELECTRON BEAM APPARATUS USING ELECTRON SOURCE, SPACERS HAVING HIGH-RESISTANCE FILM AND LOW-RESISTANCE LAYER, AND IMAGE-FORMING DEVICE USING THE SAME

(75) Inventors: Yoichi Ando, Inagi; Hideaki Mitsutake, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,250

(22) Filed: Jun. 22, 1999

(30) Foreign Application Priority Data

Jun. 24, 1998 (JP) ..... 10-177645
Jun. 21, 1999 (JP) ..... 11-174660

(51) Int. Cl.[7] ..... H01J 1/02

(52) U.S. Cl. ..... 313/310; 313/238; 313/292; 313/495; 313/496

(58) Field of Search ..... 313/495, 496, 313/497, 310, 238, 292

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,675,212 | A * | 10/1997 | Schmid et al. | 313/422 |
| 5,936,343 | A * | 8/1999 | Fushimi et al. | 313/495 |
| 6,104,136 | A | 8/2000 | Abe et al. | 313/495 |
| 6,124,671 | A * | 9/2000 | Fushimi et al. | 313/495 |
| 6,144,154 | A * | 11/2000 | Yamazaki et al. | 313/495 |
| 6,153,973 | A * | 11/2000 | Shibata et al. | 313/495 |
| 6,184,619 | B1 * | 2/2001 | Yamazaki et al. | 313/495 |
| 6,274,972 | B1 * | 8/2001 | Mitsutake et al. | 313/292 |
| 6,278,233 | B1 * | 8/2001 | Sanou et al. | 313/495 |

FOREIGN PATENT DOCUMENTS

| | | |
|---|---|---|
| EP | 0 851 457 A1 | 7/1998 |
| JP | 64-31332 | 2/1989 |
| JP | 2-257551 | 10/1990 |
| JP | 3-055738 | 3/1991 |
| JP | 4-028137 | 1/1992 |
| JP | 09007532 A * | 1/1997 |

OTHER PUBLICATIONS

W.P. Dyke et al., "Field Emission," Advances in Electronics and Electron Physics, vol. VIII, pp. 89–185, 1956.
R. Meyer, "Recent Development on 'Microtips' Display at Leti," Technical digest of 4$^{th}$ Int. Vacuum Microelectronics Conf., pp. 6–9, 1991.
C.A. Spindt, et al., "Physical Properties of Thin–Film Field Emission Cathodes with Molybdenum Cones," J. Appl. Phys., vol. 47, No. 12, pp. 5248–5263, 1976.
H. Araki, et al., "Electroforming and Electron Emission of Carbon Thin Film," J. of the Vacuum Society of Japan, vol. 26, No. 1, pp. 22–29, 1981.
M. Hartwell, et al., "Strong Electron Emission from Patterned Tin–Indium Oxide Thin Films," Int'l Electron Devices Mtg., pp. 519–521, 1975.
M. I. Elinson, et al., "The Emission of Hot Electrons and the Field Emission of Electrons from Tin Oxide," Radio Engineering and Electronic Physics, pp. 1290–1296, 1965.
C. A. Mead, "Operation of Tunnel–Emission Devices," J. of Appl. Phys., vol. 32, No. 1, pp. 646–652, 1961.
G. Dittmer, "Electrical Conduction and Electron Emission of Discontinous Thin Films," Thin Solid Films, vol. 9, pp. 317–329, 1972.

* cited by examiner

*Primary Examiner*—Nimeshkumar D. Patel
*Assistant Examiner*—Kevin Quarterman
(74) *Attorney, Agent, or Firm*—Fitzpatrick, Cella, Harper & Scinto

(57) ABSTRACT

This invention provides an arrangement for alleviating the electric charge of members apt to be electrically charged such as spacers used in an electron beam apparatus by arranging a high resistance film thereon. Particularly, the low resistance layer arranged at each of the members is covered by a high resistance film to suppress any electric discharges.

58 Claims, 20 Drawing Sheets

ELECTRON BEAM APPARATUS USING ELECTRON SOURCE, SPACERS HAVING HIGH-RESISTANCE FILM AND LOW-RESISTANCE LAYER, AND IMAGE-FORMING DEVICE USING THE SAME

BACKGROUND OF THE INVENTION

1. Field of the Invention

This invention relates to an electron beam apparatus and also to an image-forming apparatus such as display apparatus that can be realized by using it.

2. Related Background Art

There have been known two types of electron-emitting device; the hot cathode type and the cold cathode type. Of these, the cold cathode type refers to devices including surface conduction electron-emitting devices, field emission type (hereinafter referred to as the FE type) devices and metal/insulation layer/metal type (hereinafter referred to as the MIM type) electron-emitting devices.

Examples of surface conduction electron-emitting device include one proposed by M. I. Elinson, Radio Eng. Electron Phys., 10, 1290, (1965) as well as those that will be described hereinafter.

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 19 of the accompanying drawings schematically illustrates a typical surface conduction electron-emitting device proposed by M. Hartwell. In FIG. 19, reference numeral 3001 denotes a substrate. Reference numeral 3004 denotes an electroconductive thin film normally prepared by producing an H-shaped thin metal oxide film by means of sputtering, part of which eventually makes an electron-emitting region 3005 when it is subjected to an electrically energizing process referred to as "energization forming" as will be described hereinafter. In FIG. 19, the thin horizontal area of the metal oxide film separating a pair of device electrodes has a length L of 0.5 to 1 [mm] and a width W of 0.1 [mm]. Note that, while the electron-emitting region 3005 has a rectangular form and is located at the middle of the electroconductive thin film 3004, there is no way to accurately know its location and contour.

For preparing surface conduction electron-emitting devices including those proposed by M. Hartwell et al., the electroconductive film 3004 is normally subjected to an electrically energizing process, which is referred to as "energization forming", to produce an electron-emitting region 3005. In the energization forming process, a constant DC voltage or a slowly rising DC voltage that rises typically at a rate of 1V/min. is applied to given opposite ends of the electroconductive film 3004 to partly destroy, deform or transform the thin film and produce an electron-emitting region 3005 which is electrically highly resistive. Thus, the electron-emitting region 3005 is part of the electroconductive film 3004 that typically contains a gap or gaps therein so that electrons may be emitted from the gap. Note that, once subjected to an energization forming process, a surface conduction electron-emitting device comes to emit electrons from its electron emitting-region 3005 whenever an appropriate voltage is applied to the electroconductive film 3004 to make an electric current run through the device.

Examples of FE type device include those proposed by W. P. Dyke & W. W. Dolan, "Field emission", Advance in Electron Physics, 8, 89 (1956) and C. A. Spindt, "Physical Properties of thin-film field emission cathodes with molybdenum cones", J. Appl. Phys., 47, 5248 (1976).

FIG. 20 of the accompanying drawings illustrates in cross section a typical FE type device. Referring to FIG. 20, the device comprises a substrate 3010, an emitter wiring 3011, an emitter cone 3012, an insulation layer 3013 and a gate electrode 3014. When an appropriate voltage is applied between the emitter cone 3012 and the gate electrode 3014 of the device, the phenomenon of field emission appears at the top of the emitter cone 3012.

Apart from the multilayer structure of FIG. 20, an FE type device may also be realized by arranging an emitter and a gate electrode on a substrate substantially in parallel with the substrate.

MIM devices are disclosed in papers including C. A. Mead, "Operation of tunnel-emission Devices", J. Appl. Phys., 32,646 (1961). FIG. 21 illustrates a typical MIM device in cross section. Referring to FIG. 21, the device comprises a substrate 3020, a lower metal electrode 3021, a thin insulation layer 3022 as thin as 100 angstroms and an upper electrode having a thickness between 80 and 300 angstroms. Electrons are emitted from the surface of the upper electrode 3023 when an appropriate voltage is applied between the upper electrode 3023 and the lower electrode 3021 of the MIM device.

Cold cathode devices as described above do not require any heating arrangement because, unlike hot cathode devices, they can emit electrons at low temperature. Hence, the cold cathode device is structurally by far simpler than the hot cathode device and can be made very small. If a large number of cold cathode devices are densely arranged on a substrate, the substrate is free from problems such as melting by heat. Additionally, while the hot cathode device takes a rather long response time because it operates only when heated by a heater, the cold cathode device starts operating very quickly. Therefore, studies have been and are currently being conducted on cold cathode devices.

For example, since a surface conduction electron-emitting device has a particularly simple structure and can be manufactured in a simple manner, a large number of such devices can advantageously be arranged on a large area without difficulty. As a matter of fact, a number of studies have been made to fully exploit this advantage of surface conduction electron-emitting devices. Studies that have been made to arrange a large number of devices and drive them effectively include the one described in Japanese Patent Application Laid-Open No. 64-31332 filed by the applicant of the present patent application.

Applications of surface conduction electron-emitting devices that are currently being studied include charged electron beam sources and electron beam apparatuses such as image displays and image recorders.

U.S. Pat. No. 5,066,883, Japanese Patent Application Laid-Open Nos. 2-257551 and 4-28137 also filed by the applicant of the present patent application disclose image display apparatuses realized by combining surface conduction electron-emitting devices and a fluorescent panel that emits light as it is irradiated with electron beams. An image display apparatus comprising surface conduction electron-emitting devices and a fluorescent panel can be highly advantageous relative to comparable conventional apparatuses such as liquid crystal image display apparatuses that have been popular in recent years because it is of a light emissive type and does not require a backlight to make it glow.

On the other hand, U.S. Pat. No. 4,904,895 of the applicant of the present patent application discloses an image display apparatuses realized by arranging a large number of FE-type devices. Other examples of image display apparatus comprising FE-type devices include the one reported by R. Meyer [R. Meyer: "Recent Development on Microtips Display at LETI", Tech. Digest of 4th Int. Vacuum Microelectronics Conf., Nagahama, p.p 6–9 (1991)].

Japanese Patent Application Laid-Open No. 3-55738 also filed by the applicant of the present patent application describes an image display apparatus realized by arranging a large number of MIM-type devices.

Of the known image-forming apparatus comprising electron-emitting devices, those of a flat type are attracting attention and expected to replace display apparatus of the cathode ray tube type because they take little space and lightweight.

FIG. 22 is a schematic perspective view of a flat type image-forming apparatus, showing the inside by partly cutting away the display panel.

Referring to FIG. 22, there are shown a rear plate 3115, lateral walls 3116 and a face plate 3117. The envelope (airtight container) of the image-forming apparatus for maintaining the inside of the display panel in a vacuum state is formed by the rear plate 3115, the lateral walls 3116 and the face plate 3117.

A substrate 3111 is rigidly secured to the rear plate 3115 and a total of N×M cold cathode devices 3112 are arranged on the substrate 3111 (where N and M represents natural numbers not smaller than 2 that may or may not be different from each other and will be selected appropriately depending on the number of pixels to be used for displaying an image). As shown in FIG. 22, the N×M cold cathode devices are wired by M row directional wires 3113 and N column directional wires 3114. The unit comprised of the substrate 3111, the cold cathode devices 3112, the row directional wires 3113 and the column directional wires 3114 is referred to as multi-electron beam source. An insulation layer (not shown) is arranged for electric insulation between the row directional wires 3113 and the column directional wires 3114 at least at the crossings of the row directional wires 3113 and the column directional wires 3114.

A fluorescent film 3118 comprising fluorescent bodies (not shown) of the three primary colors of red (R), green (G) and blue (B) is arranged on the lower surface of the face plate 3117. Black members (not shown) are arranged to isolate each of the fluorescent bodies of the fluorescent film 3118 and a metal back 3119 typically made of Al is arranged on the side of the fluorescent film 3118 facing the rear plate 3115.

In FIG. 22, Dx1 through Dxm, Dy1 through Dyn and Hv represents respective electric terminals provided to electrically connect the display panel and an electric current (not shown) and having an airtight structure. The terminals Dx1 through Dxm are electrically connected to the row directional wires 3113 of the multi-electron beam source and the terminals Dy1 through Dyn are electrically connected to the column directional wires 3114 of the multi-electron beam source, whereas the terminal Hv is electrically connected to the metal back 3119.

The inside of the airtight container is held to a degree of vacuum of about $10^{-6}$ Torr. As the display area of the image-forming apparatus increases, means will have to be provided to prevent the rear plate 3115 and the face plate 3117 against deformation and/or destruction due to the pressure difference between the inside and the outside of the air tight container. The use of a thick rear plate 3115 and a thick face plate 3116 is not feasible because it can increase the weight of the image-forming apparatus and the image displayed on the display panel can become distorted or be accompanied by a phenomenon of parallax if viewed askant. Thus, structural supports (that are referred to as spacers or ribs) 3120 that are made of a thin glass plate are arranged in the airtight container of FIG. 22 in order to make the rear plate 3115 and the face plate 3116 withstand the atmospheric pressure. The substrate 3111 carrying thereon a multi-electron beam source and the face plate 3116 carrying thereon a fluorescent film 3118 are then separated by a distance between a fraction of a millimeter and several millimeters and the inside of the airtight container is held to an enhanced degree of vacuum as described earlier.

As a voltage is applied to the cold cathode devices 3112 of an image-forming apparatus comprising a display panel as described above by way of the extra-container terminals Dx1 through Dxm and Dy1 through Dyn, each of the cold cathode devices emits electrons. Then, a high voltage between several hundred volts and several kilovolts is applied to the metal back 3119 by way of the extra-container terminal Hv to accelerate the emitted electrons and make them collide with the inner surface of the face plate 3117. As a result of this, the fluorescent bodies of the three primary colors of the fluorescent film 3118 are energized to emit light and display an image on the display panel.

SUMMARY OF THE INVENTION

Therefore, the object of the present invention is to provide an electron beam apparatus comprising members such as spacers that can be manufactured and used to facilitate suppression of electric discharges.

According to an aspect of the invention, the above object is achieved by providing an electron beam apparatus comprising an electron source having electron beam emitting devices, an electrode for controlling electrons emitted from the electron source and members arranged between the electron source and the electrode, wherein the members have a high resistance film on the surface and at least a low resistance layer on the side facing the electrode or the electron source and the high resistance film is electrically connected to either the electrode or the electron source by way of the low resistance layer, the low resistance layer being covered at least partly by the high resistance film. For the purpose of the invention, the members may include spacers for securing a distance between the electron source and the electrode.

Preferably, the low resistance layer is covered by the high resistance film in an boundary area held in connection with the high resistance film. Alternatively, the low resistance layer may be covered by the high resistance film in an area exposed to ambient air. Alternatively, the low resistance layer may be entirely covered by the high resistance film. Preferably, the members have the low resistance layer and the high resistance film sequentially formed in the mentioned order. Alternatively, the low resistance layer may be arranged on the end face of the members facing either the electrode or the electron source and extending to the lateral sides thereof and the extended portion of the low resistance layer is covered by the high resistance film at least at the extreme ends thereof. Alternatively, the high resistance film may be arranged to cover the low resistance layer at least on the end face facing the electrode or the electron source. Still alternatively, the low resistance layer may be covered by the high resistance film at least in part of the area exposed to ambient air.

For the purpose of the invention, a low resistance layer refers to a layer that substantially facilitates the movement of an electric charge from the high resistance film to the electron source or the control electrode (acceleration electrode) if compared with an arrangement that is devoid of such a low resistance layer. More specifically, the high resistance film shows a resistivity higher than the low resistance layer and/or the sheet resistance of the high resistance film is higher than that of the low resistance layer so that the movement of carriers from the high resistance film toward the electron source or the control electrode is facilitated.

According to another aspect of the invention, there is provided an electron beam apparatus comprising an electron source having electron beam emitting devices, an electrode separated from the electron source and members arranged between the electron source and the electrode, wherein the members have a film arranged on the surface and adapted to allow a minute electric current to flow therethrough and an end electrode arranged at least at the end facing the electron source or the electrode, the film covering at least part of the end electrode.

Preferably, the end electrode is covered by the film at least in the area connected to the film. Alternatively, the end electrode may be covered by the film in an area exposed to ambient air. Alternatively, the end electrode may be entirely covered by the film. Preferably, the members have the low resistance layer and the high resistance film sequentially formed in the mentioned order. Alternatively, the end electrode may be arranged on the end face of the members facing either the electrode or the electron source and extending to the lateral sides thereof and the extended portion of the low resistance layer is covered by the film at least at the extreme ends thereof. Alternatively, the high resistance film may be arranged to cover the low resistance layer at least on the end face facing the electrode or the electron source.

For the purpose of the invention, the film is preferably adapted to alleviate the electric charge produced by electrons striking the member. More specifically, the film is preferably adapted to allow a minute electric current to flow therethrough.

Preferably, the electron source has a plurality of electron emitting devices connected by wires and the members are electrically connected to the wires.

Preferably, the electron source has a plurality of electron emitting devices connected by a plurality of row directional wires and a plurality of column directional wires for a matrix wiring arrangement.

Preferably, the electrode is an acceleration electrode for accelerating electrons emitted from the electron source.

For the purpose of the invention, the electron emitting devices are cold cathode devices or surface conduction electron emitting devices.

According to a still another aspect of the invention, there is provided an image-forming apparatus comprising an electron beam apparatus and adapted to irradiate a target with electrons emitted from cold cathode devices according to an input signal to form an image. Preferably, the target is a fluorescent body.

If the low resistance layer is covered at least partly by the high resistance film, any electric discharge that may be caused by a concentrated electric field of the low resistance layer can be effectively prevented from taking place.

According to still another aspect of the invention, there is provided a method of manufacturing a member to be used in an electron beam apparatus having an electron source and an electrode separated from the electron source, the member being adapted to be arranged between the electron source and the electrode, the member having a low resistance layer arranged at least on the side facing the electrode or the electron source and a high resistance film electrically connected to the low resistance layer, the method comprising a step of forming the high resistance film to cover at least part of the low resistance layer.

Preferably, in the step of forming the high resistance film, the high resistance film is formed on the low resistance layer at least on the side facing the electrode or the electron source of the member and, at the same time, on the sides other than the side facing the electron source or the electrode to facilitate the manufacture of the member.

According to still another aspect of the invention, there is also provided a method of manufacturing a member to be used in an electron beam apparatus having an electron source and an electrode separated from the electron source, the member being adapted to be arranged between the electron source and the electrode, the member having an end electrode arranged at least on the side facing the electron source or the electrode and a film electrically connected to the end electrode, the method comprising a step of forming the film to cover at least part of the end electrode.

Preferably, in the step of forming the film, the film is formed at least on the side facing the electron source or the electrode and, at the same time, on the sides other than the side facing the electron source or the electrode to facilitate the manufacture of the member.

DETAILED DESCRIPTION OF THE PREFERRED EMBODIMENTS

Now, the present invention will be described in greater detail by referring to the accompanying drawings that illustrate preferred embodiments of the invention.

Embodiment 1

The display panel of an image-forming apparatus is normally accompanied by the following problems.

Firstly, as a voltage exceeding several hundred volts (or a strong electric field exceeding 1 kV/mm) is applied between the multi-electron beam source and the face plate 3117 to accelerate the electron beams emitted from the cold cathode devices 3112, creeping discharges can occur on the surface of the spacers 3120. Particularly, an electric discharge can be induced when any of the spacers 3120 is electrically charged as electrons emitted from a nearby area collide with the spacer or as ions generated by emitted electrons adhere to the spacer.

A technique of causing a minute electric current to flow through the spacers to remove the electric charge therefrom has been proposed to solve the above problem. With this proposed technique, a high resistance film is typically formed on the spacers that are insulators of electricity to allow a minute electric current to flow therethrough. The high resistance film, or antistatic film, typically is a thin film of tin oxide or of a mixture of tin oxide and indium oxide or a metal film.

In order to make the antistatic film operate reliably, an electroconductive film is arranged on the surface of the spacer 3120 in the area where the spacer 3120 contact with the substrate 3111 or the fluorescent film 3118 and a surrounding area. With such an arrangement, the electric connection between the antistatic film and the substrate 3111 or the fluorescent film 3118 will be secured.

Secondly, as a high voltage is applied between the substrate 3111 and the fluorescent film 3118, a concentrated electric field can appear along the boundary of the electroconductive film and the antistatic film to give rise to an electric discharge. Electric discharges of this type can occur abruptly while the image-forming apparatus is operating to display images. Then, the images will be disturbed and additionally the cold cathode devices located nearby will be remarkably degraded to make it no longer possible for the image-forming apparatus to operate properly.

This embodiment is designed to overcome the above identified problems accompanying the use of known spacers and appropriately suppress any possible electric discharges that can occur when the image-forming apparatus is operating for displaying images so that the image-forming apparatus may constantly produce fine images.

(1) Configuration of Image-Forming Apparatus

Now, the configuration of a display panel that can be used for an image forming apparatus according to the invention and a method of manufacturing it will be described.

Figure 1:
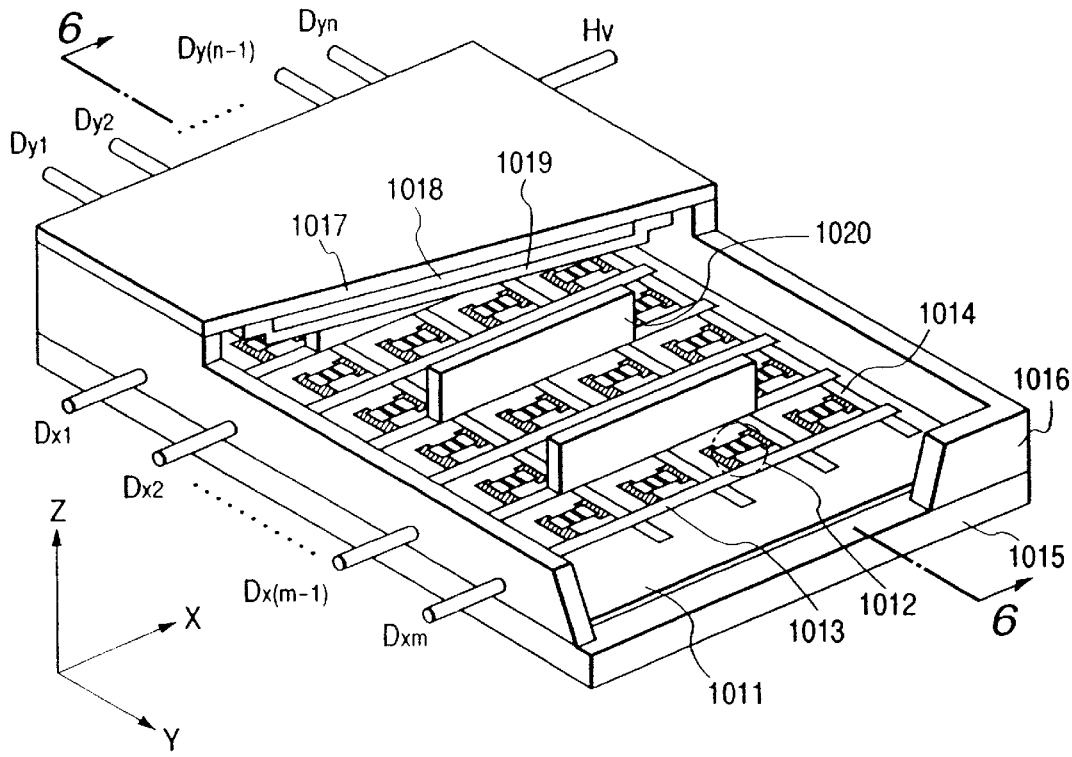
FIG. 1 is a schematic perspective view of an embodiment of image-forming apparatus according to the invention, showing the inside by partly cutting away the display panel thereof.

FIG. 1 shows a schematic perspective view of the display panel which is partially broken to illustrate the inside.

Referring to FIG. 1, the apparatus comprises a rear plate 1015, lateral walls 1016 and a face plate 1017 to form an envelope that is airtightly sealed to maintain the inside in a vacuum condition. For assembling the airtight container, it is necessary to tightly bond the components of the airtight container in order to secure a sufficient level of strength and airtightness for the components. Therefore, frid glass is typically applied to the areas of the components that are put together and baked at 400 to 500° C. for more than 10 minutes to realize a satisfactory bonding effect. The technique of evacuating the inside of the airtight container will be described hereinafter. Additionally, since the inside of the airtight container is held to a degree of vacuum of about $10^{-6}$ Torr, spacers 1020 are arranged as anti-atmospheric-pressure structures in order to protect the airtight container against the atmospheric pressure and unexpected impacts that can otherwise damage the airtight container.

Now, an electron source substrate that can be used for an image-forming apparatus according to the invention will be described.

An electron source substrate to be used for an image-forming apparatus according to the invention can be prepared by arranging a plurality of electron-emitting devices that are cold cathode devices on a substrate.

For the purpose of the invention, cold cathode devices may be arranged in various different ways. For example, an electron source substrate can be realized by arranging cold cathode devices in parallel rows and connecting them with wires at the opposite ends of each of them to produce a ladder type arrangement (hereinafter referred to as ladder type electron source substrate). Alternatively, an electron source substrate can be realized by connecting the paired device electrodes respectively with X-directional wires and Y-directional wires to produce a simple matrix arrangement (hereinafter referred to as matrix type electron source substrate). An image-forming apparatus comprising a ladder type electron source substrate requires a control electrode (grid electrode) for controlling the flying behaviour of electrons emitted from the electron-emitting devices.

The substrate 1011 is rigidly secured to the rear plate 1015 and a total of N×M cold cathode devices 1012 are formed on the substrate 1011, where N and M are integers not smaller than 2 that may or may not be the same and will be selected appropriately as a function of the number of pixels to be used for displaying images. For instance, if the apparatus is a high definition television set, N and M are preferably equal to or greater than 3,000 and 1,000 respectively. The N×M cold cathode devices are wired by N row-directional wires 1013 and M column-directional wires 1014 to realize a simple matrix wiring arrangement. The unit constituted by the substrate 1011, the cold cathode devices 1012, the row-directional wires 1013 and the column-directional wires 1014 is referred to as multi-electron beam source.

For the purpose of the invention, any method may be used for preparing a multi-electron beam source to be used for an image-forming apparatus according to the invention so long as it shows a simple matrix type arrangement or a ladder type arrangement.

Therefore, for the purpose of the invention, a multi-electron beam source may comprise surface conduction electron-emitting devices or FE-type or MIM-type cold cathode devices.

Now, a multi-electron beam source realized by arranging surface conduction electron-emitting devices (which will be described hereinafter) on a substrate as cold cathode devices for a matrix wiring arrangement will be described in terms of configuration.

Figure 2:
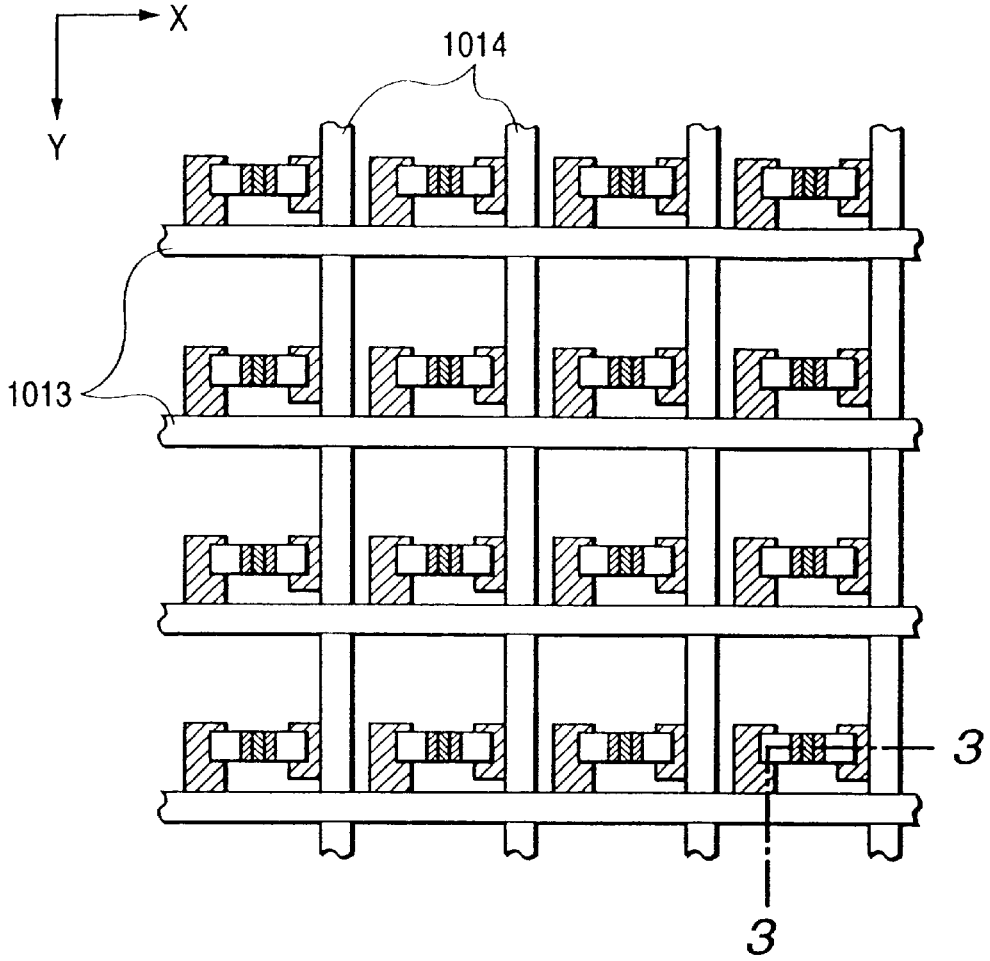
FIG. 2 is a schematic cross sectional view of the display panel of a second embodiment of the invention.
Figure 8A:
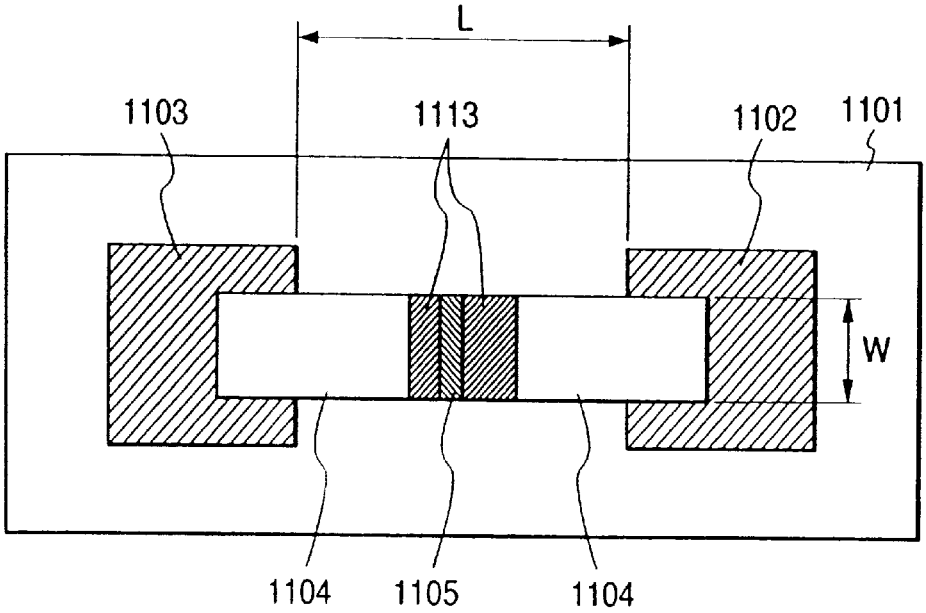
FIGS. 8A and 8B are a schematic plan view and a schematic cross sectional view of a flat-type surface conduction electron emitting device that can be used in any of the embodiments of the invention.
Figure 8B:
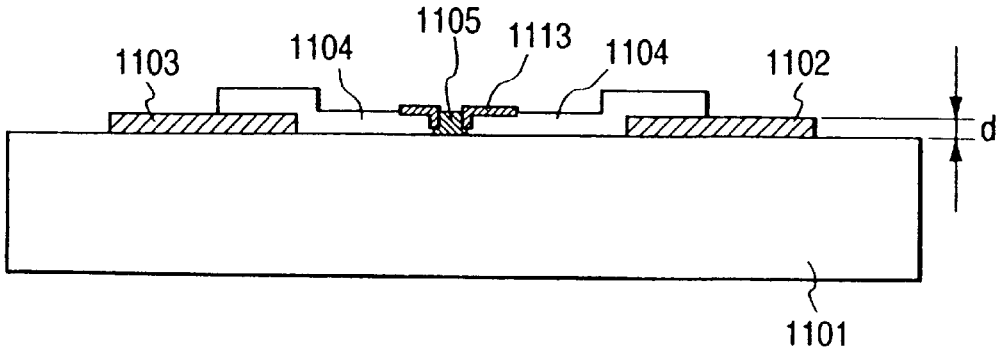

FIG. 2 is a schematic plan view of a multi-electron beam source that can be used for the display panel of FIG. 1. A number of surface conduction electron-emitting devices similar to the one shown in FIGS. 8A and 8B are arranged on a substrate 1011 and electrically connected by way of row-directional wires 1013 and column-directional wires 1014 to produce a matrix-wiring arrangement. An insulation layer (not shown) is arranged to electrically isolate the electrodes of each of the surface conduction electron-emitting devices at the crossings of the row-directional wires 1013 and the column-directional wires 1014.

Figure 3:
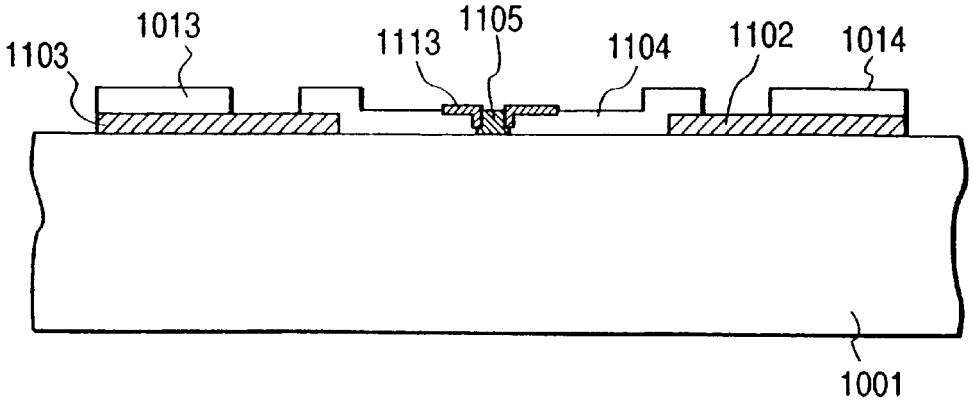
FIG. 3 is a schematic cross sectional view of the display panel of a third embodiment of the invention.

FIG. 3 is a cross sectional view of the multi-electron beam source of FIG. 2 taken along lines 3—3 in FIG. 2.

A multi-electron beam source having the illustrated configuration can be prepared by arranging row-directional wires 1013, column-directional wires 1014, an inter-electrode insulation layer (not shown) and device electrodes and electrocoductive thin film of surface conduction electron-emitting devices on a substrate in advance and subsequently subjecting the devices to an energization forming process (as will be described in greater detail hereinafter) and a current conduction process by supplying them with electricity by way of the row-directional wires 1013 and the column-directional wires 1014.

While the substrate 1011 of the multi-electron beam source is rigidly secured to the rear plate 1015 of the airtight container in this embodiment, the substrate 1011 of the multi-electron beam source itself may be used to operate as rear plate of the airtight container if the substrate 1011 of the multi-electron beam source has a sufficient degree of strength.

Figure 4A:
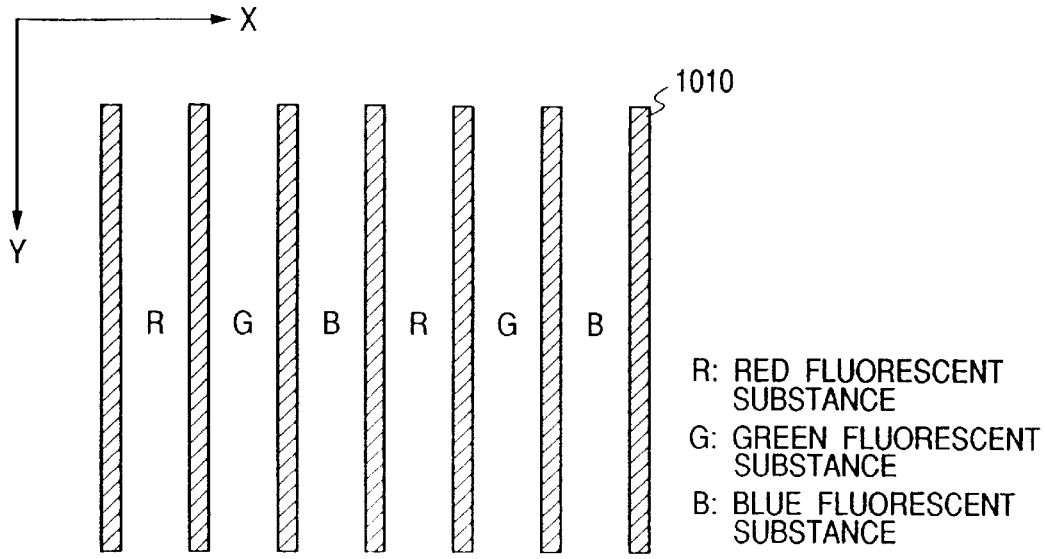
FIGS. 4A and 4B are schematic plan views of the face plate of a display panel according to the invention, showing a possible arrangement of fluorescent bodies.

A fluorescent film 1018 is formed under the face plate 1017. Since the mode of realizing the present invention as described here corresponds to a color display apparatus, fluorescent bodies of red, green and blue are arranged on respective areas of the film 1018 as in the case of ordinary color CRTs. In the case of FIG. 4A, fluorescent bodies of three different colors are realized in the form of so many stripes and any adjacent stripes are separated by a black electroconductive member 1010. Black electroconductive members 1010 are arranged for a color display panel so that no color breakups may appear if electron beams do not accurately hit the target, that the adverse effect of external light of reducing the contrast of displayed images may be reduced and that the fluorescent film may not be electrically charged up by electron beams. While graphite is normally used for the black electroconductive members 1010, other conductive material having low light transmissivity and reflectivity may alternatively be used.

Figure 4B:
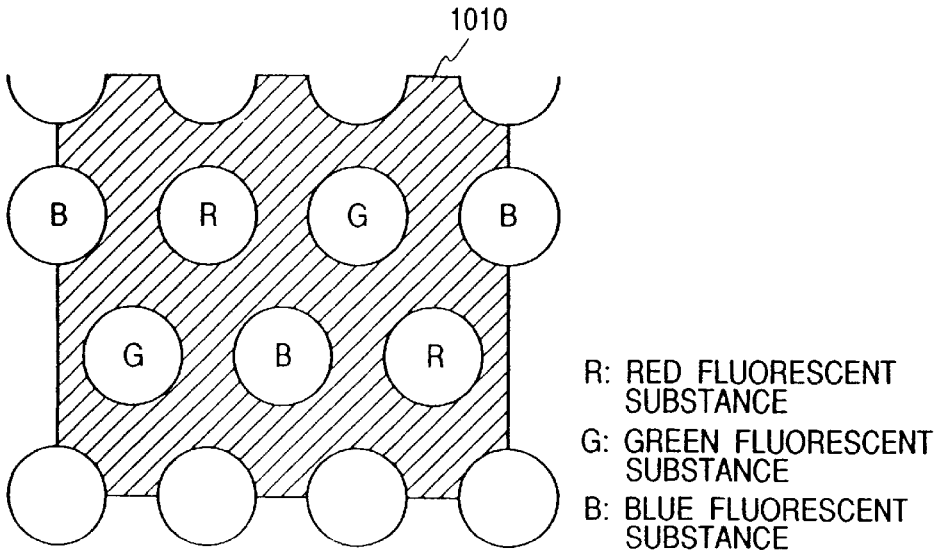
Figure 5:
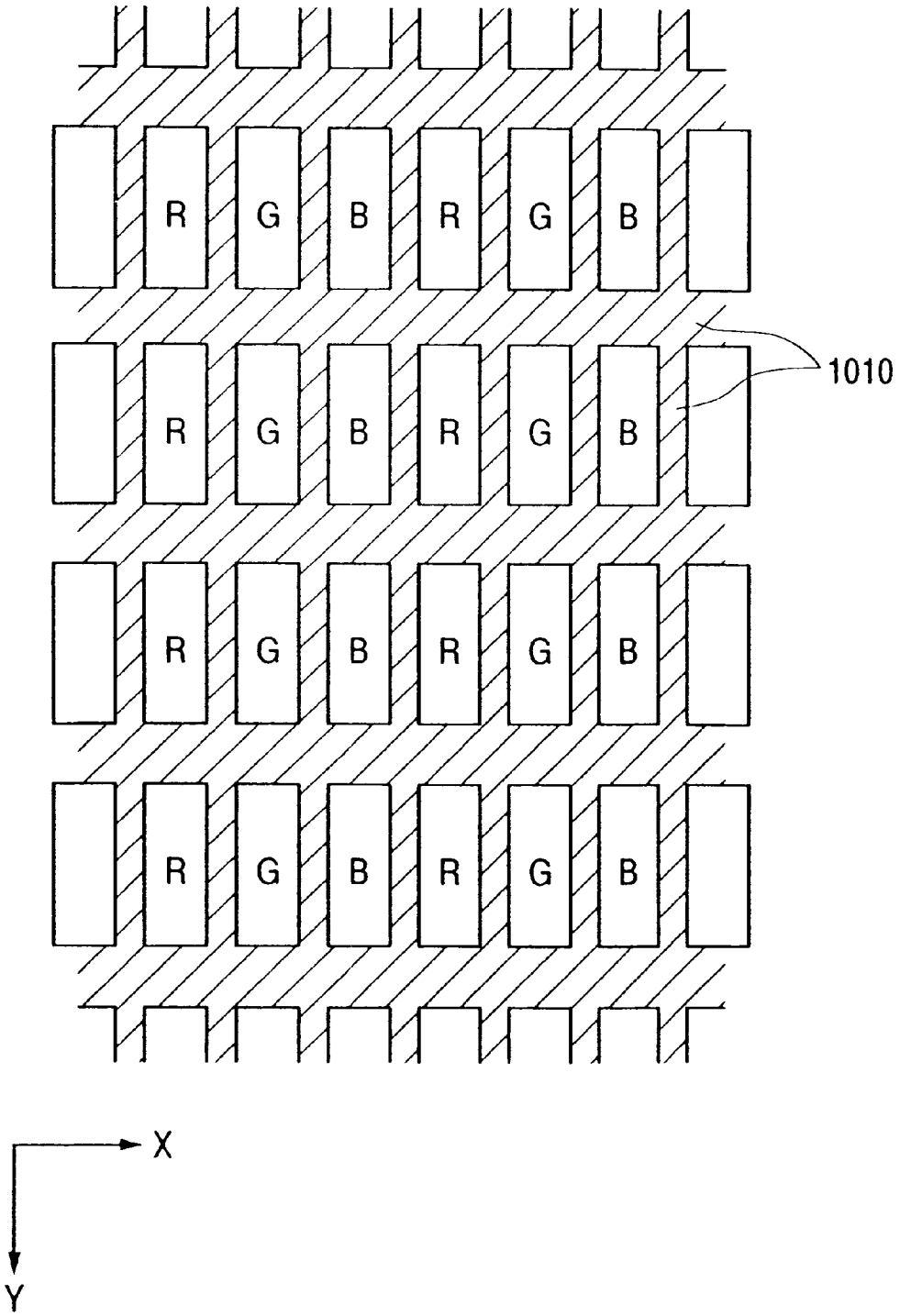
FIG. 5 is a schematic plan view of the face plate of a display panel according to the invention, showing another possible arrangement of fluorescent bodies.

The striped pattern of FIG. 4A for fluorescent bodies of the three primary colors may be replaced by a triangular arrangement of round fluorescent bodies of three primary colors as shown in FIG. 4B or some other arrangement (as shown in FIG. 5).

A monochromatic fluorescent film 1018 is used for a black and white display panel. Black electrocoductive members may not necessarily be used for the purpose of the invention.

An ordinary metal back 1019 well known in the art of CRT is arranged on the inner surface of the fluorescent film 1018, which is the side of the fluorescent film closer to the rear plate. The metal back 1019 is arranged in order to reflect back part of rays of light emitted by the fluorescent film 1018 and enhance the efficiency of utilization of light, to protect the fluorescent film 1018 against collision of negative ions, to utilize it as electrode for applying a voltage for accelerating electron beams and to provide guide paths for electrons for exciting the fluorescent film 1018. The metal back 1019 is prepared by smoothing the inner surface of the fluorescent film 1018 and forming an Al film thereon by vacuum evaporation after preparing the fluorescent film 1018 on the face plate substrate 1017. The metal back 1019 may not be necessary if a fluorescent material that is good for a low voltage is used for the fluorescent film 1018.

A transparent electrode typically made of ITO may be arranged between the face plate substrate 1017 and the fluorescent film 1018 in order to apply an accelerating voltage and raise electroconductivity of the fluorescent film 1018, although such an electrode not used in this embodiment.

(Spacer)

Figure 6:
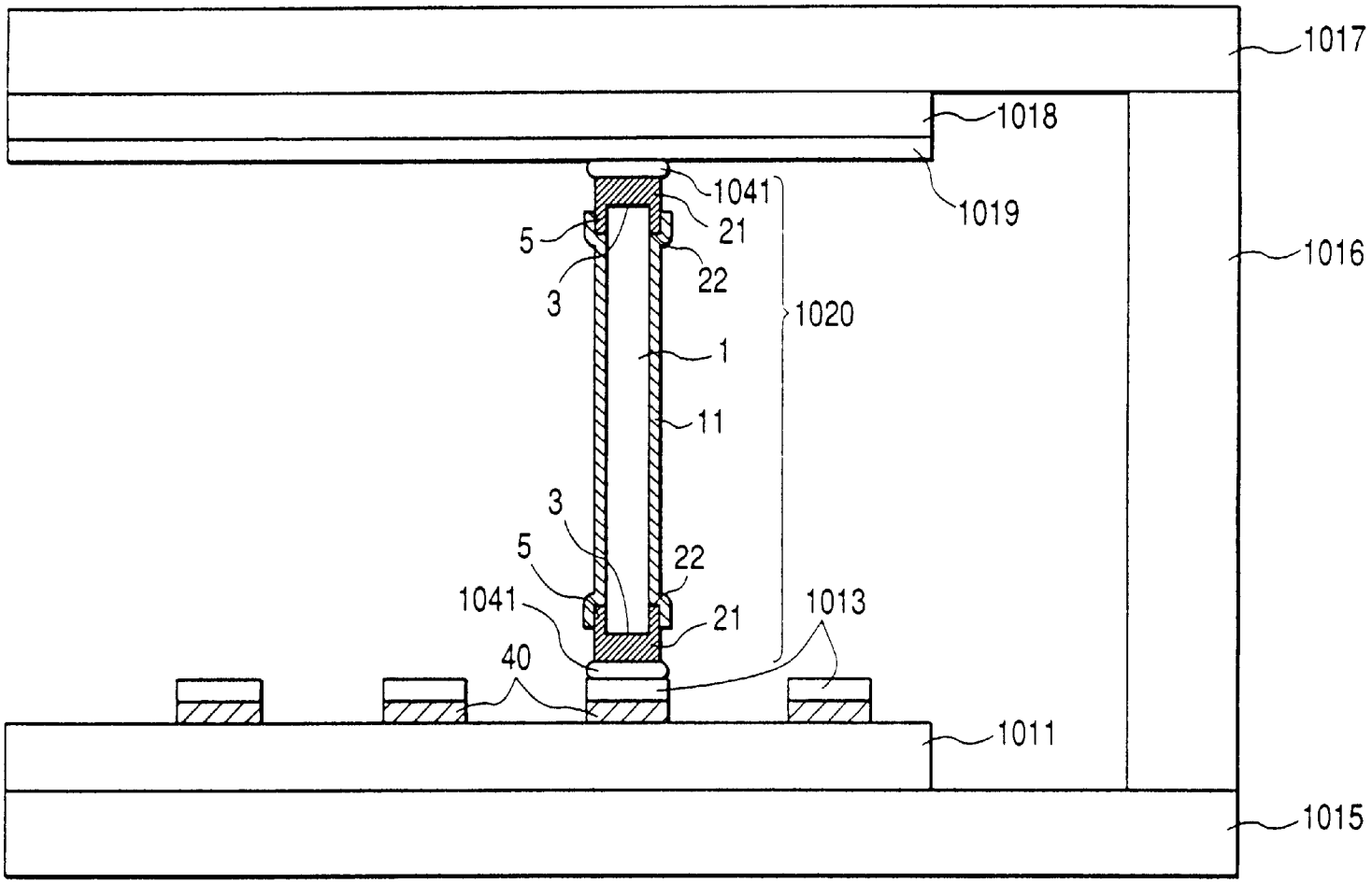
FIG. 6 is a schematic cross sectional view of a first embodiment of display panel according to the invention.

FIG. 6 is a schematic cross sectional view of the image-forming apparatus of FIG. 1 taken along line 6—6 in FIG. 1. In FIG. 6, the components same as those of FIG. 1 are denoted respectively by the same reference symbols. Each of the spacers is prepared by forming a low resistance layer 21 on an insulating member 1 at the abutting surface 3 facing the inner surface of the face plate 1017 (or the metal back 1019) and the abutting surface 3 facing the surface of the corresponding wire (row-directional wire 1013 or column-directional wire 1014) on the related device electrode 40 on the substrate 1011 and neighboring areas of the lateral surfaces and then forming a high resistance film 11 on the lateral surfaces for the prevention of accumulation of electric charge. A number of spacers necessary for achieving the object of arranging spacers will be provided and bonded to the inside of the face place 1017 and the surface of the substrate 1011 by means of a bonding agent 1041.

As seen from FIG. 6, the high resistance film 11 is formed to cover the edges of the low resistance layer 21 where the low resistance layer 21 (also referred to as end electrode) and the high resistance film 11 contact with each other and electrically connected to the inner surface of the face plate 1017 (or the metal back 1019) and the surface of the substrate 1011 (and the row-directional wire 1013 or the column-directional wire 1014) by way of the low resistance layer 21 and the bonding agent 1041 on the spacer 1020.

As a low resistance layer 21 and a high resistance film 11 are sequentially formed, at the low resistance layer 21 facing to the rear plate 1015, the edge 22 of the low resistance layer 21 located closest to the face plate 1017 is completely covered by the high resistance film 11 so that any possible formation of a concentrated electric field in these areas can be avoided or alleviated to improve the creeping discharge withstand voltage of the spacer.

Now, the reasons why the creeping discharge withstand voltage of the spacer is improved by the above arrangement will be discussed in detail below.

Figure 7B:
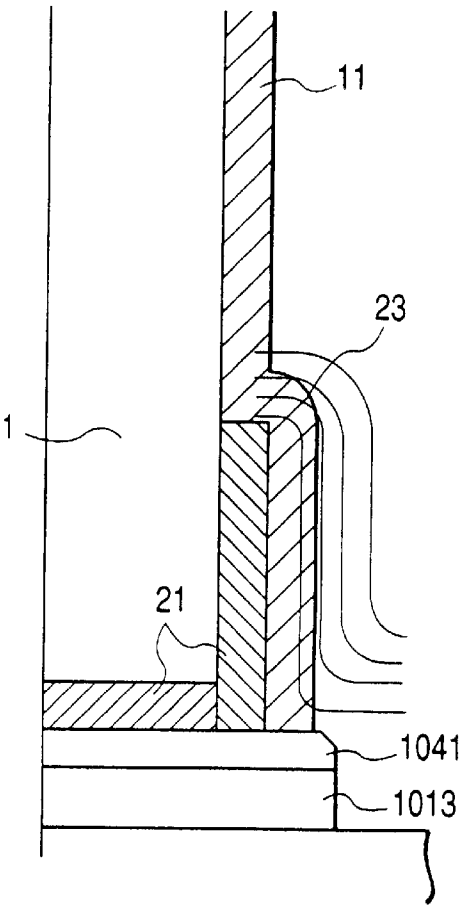
FIGS. 7A and 7B are schematic cross sectional partial views of the first embodiment of display panel, illustrating its detailed configuration.
Figure 7A:
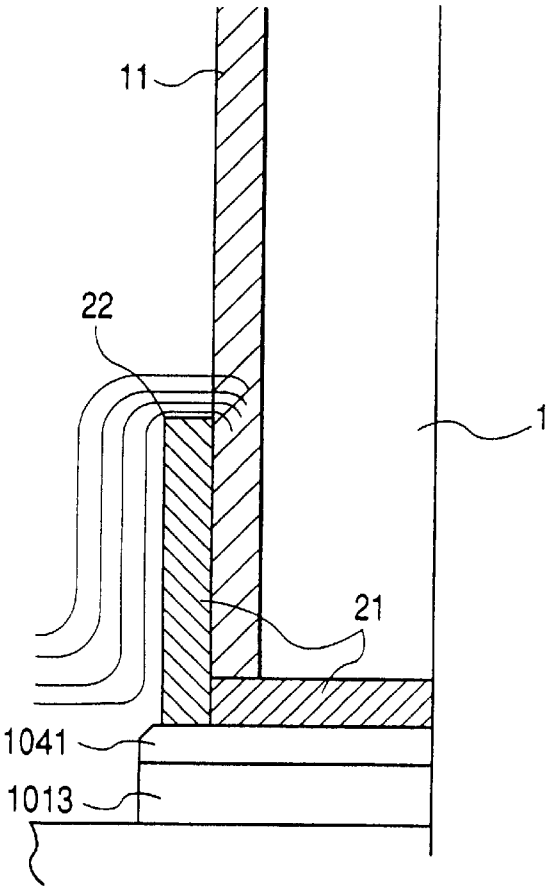

FIG. 7A is a schematic cross sectional view of a display panel, showing only a single spacer 1, on which a high resistance film 11 and a low resistance layer 21 are sequentially formed. FIGS. 7A and 7B are schematic cross sectional views of another display panel, also showing only a single spacer 1, on which an insulation member, a low resistance layer 21 and a high resistance film 11 are formed sequentially. The arrangement of FIG. 7B corresponds to that of the second embodiment as will be described hereinafter by referring to FIG. 17, where the low resistance layer 21 is entirely covered by the high resistance film 11 at a side. The curves in FIGS. 7A and 7B are schematically illustrated equipotential lines.

In FIG. 7A, equipotential lines are densely drawn at and near the edge 22 of the low resistance layer 21 where it is exposed to vacuum to indicate that the electric field is concentrated there.

In FIG. 7B, on the other hand, the low resistance layer 21 is not exposed to vacuum at and near the edge 22 where the electric field is concentrated. Additionally, the concentration of electric field at and near the edge 23 of the high resistance film 11 where it is exposed to vacuum is alleviated if compared with the corresponding edge 22 of the low resistance film 21 of FIG. 7A.

Various theories have been proposed to explain the mechanism of a creeping discharge, although it has not been clarified to date. However, it is a generally accepted view that it is triggered by field emission electrons emitted from the cathode side and ends up with a flash over that occurs in the gas phase near the surface.

Thus, the inventors of the present invention believe that the creeping discharge withstand voltage is improved by eliminating any spot on the cathode side surface where the electric field is concentrated and thereby reducing the rate of emission of field emission electrons.

Additionally, by comparing the edge section 22 of the low resistance layer 21 of FIG. 7A and the edge section 23 of the high resistance film 11 of FIG. 7B, it is clear that the latter shows a rounded profile due to the coverage effect of the high resistance film 11. It will be safe to assume that the concentration of the electric field on the cathode side is alleviated by the effect of the profile.

The inventors also believe that the concentration of the electric field can also be alleviated on the anode side to suppress any possible electric discharges, although the suppressing effect may be different from that of the cathode side.

In the above described mode of carrying out the invention, the spacers have a profile of a thin plate and are arranged in parallel with the row-directional wires 1013 and connected to the column-directional wires 1014.

The spacers 1020 may be made of any material that provides sufficient electric insulation and withstands the high voltage applied between the related row-directional wire 1013 or the related column-directional wire 1014 on the substrate 1011 and the metal back 1019 on the inner surface of the face plate 1017, while showing a degree of surface conductivity for effectively preventing an electric charge from building up on the surface of the spacers.

Materials that can be used for the insulation members 1 of the spacers 1020 include quartz glass, glass containing impurities such as Na to a reduced concentration level, soda lime glass, alumina and other ceramic materials. It is preferable that the material of the insulation members 1 has a thermal expansion coefficient substantially equal to those of the materials of the airtight container and the substrate 1011.

An electric current equal to the value obtained by dividing the acceleration voltage Va applied to the face plate 1017 (metal back 1019) that shows an electrically higher potential by the resistance Rs of the high resistance film 11 that is the anti-charge film. Thus, electric resistance Rs of the spacer 1020 should be found within a desirable range from the viewpoint of anti-charge effect and power consumption rate. Anti-charge effect is effective in a range of which the surface electric resistance R/□ is between less than than $10^{14}$ Ω/□, preferably between less than $10^{12}$ Ω/□, more preferably less than $10^{11}$ Ω/□ in order to maintain the effect of preventing electrification of the surface. While the lower limit of the surface resistance can vary depending on the profile of the spacer and the voltage Va that is applied between two edges of the spacer, it is preferably over than $10^5$ Ω/□, more preferably over than $10^7$ Ω/□.

The anti-charge film formed on the insulating material preferably has a film thickness t between 10 nm and 1 μm. Generally, a thin film with a thickness less than 10 nm are formed to show an island state and its electric resistance is unstable and poorly reproducible although it may vary depending on the surface energy of the material, the bonding tightness of the substrate 1011 and the face plate 1017 (metal back 1019). On the other hand, a film having a film thickness greater than 1 μm shows a large stress and can be peeled off from the substrate. Additionally, a film with a large film thickness requires a long process time for the film forming process at the cost of productivity. In view of these factors, the film thickness is preferably between 50 and 500 nm. The surface resistance R/□ is expressed by ρ/t (ρ being the specific resistance of the film) and, in view of the preferable range cited above for R/□, the specific resistance ρ of the anti-charge film is preferably between 0.1 [Ωcm] and $10^8$ [Ωcm]. For providing a preferable range for both the surface resistance and the film thickness, ρ preferably shows a value between $10^2$ [Ωcm] and $10^6$ [Ωcm].

As described above, the spacer carries an anti-charge film formed thereon in a manner as described above and the temperature of the spacer rises as an electric current is made to flow therethrough or as the display panel emits heat during its operation. Thus, if the anti-charge film has a temperature coefficient of resistance that is a large negative value, the resistance will be reduced as the temperature rises to increase the electric current flowing through the spacer 1020 so that consequently the temperature will further rise. Empirically, a runaway of electric current occurs in a manner as described above when the absolute value of the negative temperature coefficient of resistance exceeds 1%. In other words, the temperature coefficient of resistance of the anti-charge film is preferably not greater than −1%.

The high resistance film 11 that shows an anti-charge effect can be made of metal oxide. Materials that can preferably be used for the high resistance film 11 includes oxides of chromium, nickel and copper. This may be because these oxides shows a relatively small secondary electron emission efficiency and therefore the spacers 1020 carrying a high resistance film made of such a material can hardly become electrically charged if electrons emitted from the cold cathode devices 1012 collide with the spacers 1020. Beside metal oxide, carbon may also suitably be used for the high resistance film 11 because it also shows a small secondary electron emission efficiency. Particularly, the use of amorphous carbon is preferable because it shows a high resistance and hence the resistance of the spacer can be controlled within a desired range by using amorphous carbon.

Nitride of an alloy of aluminum and transition metal is also a material that can suitably be used for the high resistance film 11 having an anti-charge effect because, if such a material is used for the high resistance film, the resistance of the spacer can be controlled reliably within a desired range by regulated the composition of the nitride between that of an electrically conductive material and that of an insulator. Additionally, such a material remains stable in the process of preparing the display apparatus as will be described hereinafter because its resistance varies little. Still additionally, the temperature coefficient of resistance of such a material is less than −1% and hence adapted to practical applications. Transition metals that can be used for the purpose of the invention include Ti, Cr and Ta.

A thin film of nitride of an alloy can be formed on an insulating material by using an ordinary thin film forming technique selected from reactive sputtering, electron beam evaporation, ion plating, ion-assisted evaporation and others in a nitrogen gas atmosphere. A metal oxide film can also be formed by such a thin film forming technique when oxygen gas is used in place of nitrogen gas. A technique of CVD or alkoxyde application may also be used for forming a thin metal oxide film. A carbon film can be formed by evaporation, sputtering, CVD or plasma CVD. When forming an amorphous carbon thin film, the film forming process will be conducted in a hydrogen-containing atmosphere or the film forming gas will be made to contain gaseous hydrocarbons.

The low resistance layer 21 is arranged on the spacer 1020 to electrically connect the high resistance film 11 to the face plate 1017 (metal back 1019) showing an electrically high potential and the substrate 1011 (row-directional wires 1013 and column-directional wires 1014) showing an electrically low potential. Therefore, it may also be referred to as intermediary electrode layer (intermediary layer) in the following description. The intermediary electrode layer (intermediary layer) can be made to operate with a plurality of functions (1) through (3) as listed below.

(1) To connect the high resistance film 11 to the face plate 1017 and the substrate 1011.

As described above, the high resistance film 11 is arranged to eliminate any electric charge on the surface of the spacer. However, when the high resistance film 11 is connected to the face plate 1017 (metal back 1019) and the substrate 1011 (wires 1013, 1014) directly or by way of an abutting member 1041, a large contact resistance can appear on the connection interfaces to make it difficult to quickly remove the electric charge that can be produced on the surface of the spacer. Thus, a low resistance intermediary layer 21 (end electrode) is arranged on the abutting surfaces 3 where the face plate 1017 and the substrate 1011 contact with the respective abutting members 1041 and on the lateral sides 5 in order to avoid such a situation.

(2) To provide a uniform distribution of electric potential of the high resistance film 11.

Electrons emitted from the cold cathode devices 1012 show a trajectory that is defined by the distribution of electric potential between the face plate 1017 and the substrate 1011. Then, the distribution of electric potential of the high resistance film 11 has to be controlled over the entire surface thereof in order to prevent any turbulence from appearing in the trajectories of electrons on and near the spacer 1020. However, when the high resistance film 11 is connected to the face plate 1017 (metal back 1019) and the substrate 1011 (wires 1013, 1014) directly or by way of an abutting member 1041, the connection can show a certain degree of unevenness due to the contact resistance on the connection interface and the distribution of electric potential of the high resistance film 11 can become disturbed to an undesirable extent. Thus, a low resistance intermediary layer 21 is arranged on the entire extreme areas (abutting surfaces 3 and lateral sides 5) where the spacer 1020 abuts the face plate 1017 and the substrate 1011 so that the electric potential of the entire high resistance film 11 may be controlled by applying an appropriate voltage to the intermediary layer.

(3) To control the trajectories of emitted electrons.

Electrons emitted from the cold cathode devices 1012 show a trajectory that is defined by the distribution of electric potential between the face plate 1017 and the substrate 1011. Therefore, the arrangement of spacers 1020 may have to be subjected to certain restrictions (requiring rearrangement of the wires and the devices) for the sake of electrons emitted from the cold cathode devices 1012 located close to the spacers. Then, the trajectories of emitted electrons will have to be so controlled as to make them strike the face plate 1017 at desired respective spots. The trajectories of emitted electrons can be controlled by arranging an intermediary layer on the lateral sides 5 where the spacer abuts the face plate 1017 and the substrate 1011 and making the distribution of electric potential at and near the spacer 1020 show a desired pattern.

A material showing a resistance sufficiently lower than the high resistance film 11 will be used for the low resistance layer 21, or the intermediary layer. Materials that can be used for the low resistance layer 21 include metals such as Ni, Cr, Au, Mo, W, Pt, Ti, Al, Cu and Pd, alloys of any of them, printed conductors made of metal or metal oxide such as Pd, Ag, Au, $RuO_2$ and Pg—Ag and glass, transparent conductors such as $InO_2O_3$—$SnO_3$.

The bonding agent 1041 has to be made electroconductive in order to make the spacers 1020 to be electrically connected to the row-directional wires 1013 and the metal back 1019. Therefore, frit glass containing an electrocoductive adhesive, metal particles and an electrocoductive filler material will suitably be used for the bonding agent 1041.

Terminals Dx1 through Dxm, Dy1 through Dyn and Hv shown in FIG. 1 are airtightly constructed and arranged to electrically connect the display panel and an electric circuit (not shown). Terminals Dx1 through Dxm are electrically connected to the row-directional wires 1013 of the multi-electron beam source and terminals Dy1 through Dyn are connected to the column-directional wires 1014, whereas terminal Hv is electrically connected to the metal back 1019 of the face plate.

When evacuating the inside of the airtight container after assembling the container, the exhaust pipe (not shown) of the container is connected to a vacuum pipe and the inside is evacuated to a degree of vacuum of $10^{-7}$[ Torr]. Then, the exhaust pipe will be hermetically sealed. Note that a getter film (not shown) is formed at a given location within the envelope immediately before or after sealing the exhaust pipe as means for maintain the inside of the envelope to a given degree of vacuum. Getter film is a film obtained by evaporation, where the getter material typically containing Ba as a principal ingredient is heated by means of a heater or high frequency heating. The inside of the envelope is maintained to a degree of vacuum of $1\times10^{-5}$ to $1\times10^{-7}$ Torr by the adsorption effect of getter film.

In an image display apparatus comprising a display panel as described have, the cold cathode devices are driven to emit electrons when a voltage is applied to the devices by way of the external terminals Dx1 through Dxm and Dy1 through Dyn while a high voltage between several hundred [V] and several [kV] is applied to the metal back 1019 by way of the high voltage terminal Hv to accelerate electrons emitted from the devices and make them collide with the face plate 1017 at high speed. Then, the fluorescent bodies of the primary colors of the fluorescent film 1018 are energized to emit light and produce an image on the display screen.

Normally, the voltage applied to the cold cathode devices 1012, or the surface conduction electron-emitting devices, is between 12 and 16 [V] and the distance d separating the metal back 1019 and the cold cathode devices 1012 is between 0.1 [mm] and 8 [mm], while the voltage applied between the metal back 1019 and the cold cathode devices 1012 is between 0.1 [kV] and 10 [kV].

Thus, this embodiment of image-forming apparatus according to the invention has a display panel having a configuration as described above and prepared in the above described manner. Note that the structure and the improved performance of the spacers 1020 are very important.

(2) Method of Preparing Multi-Electron Beam Source

Now, a method of manufacturing a multi-electron beam source that can be used for the display panel of the above embodiment will be described. Any multi-electron beam source comprising a number of cold cathode devices arranged in the form of a matrix may be used for the purpose of the invention regardless of the material and the profile of the cold cathode devices. In other words, cold cathode devices that can be used for the purpose of the invention include surface conduction electron-emitting devices, FE-type cold cathode devices and MIM-type cold cathode devices.

However, under the current circumstances where image display apparatus having a large display screen and available at low cost are very popular, the use of surface conduction electron-emitting devices is particularly advantageous. As described earlier, the electron emission performance of an FE-type cold cathode device is highly dependent on the relative positions and the profiles of the emitter cone and the gate electrode and hence high precision techniques are required for manufacturing it, which are by any means disadvantageous for producing large screen image display apparatus at low cost. On the other hand, an MIM-type device requires a very thin insulation layer and an upper electrode that needs to be very thin too. These requirements also provide disadvantages if such devices are used for large screen image display apparatuses that have to be manufactured at low cost. Contrary to these devices, a surface conduction electron-emitting device can be manufactured in a relatively simple manner and, therefore, large screen image display apparatuses comprising such devices can be manufactured at relatively low cost.

Additionally, the inventors of the present invention has discovered that a surface conduction electron-emitting device where the electron-emitting region and its surrounding area are formed by a film of fine particles is particularly excellent in the performance of electron emission and can be manufactured with ease. Thus, such surface conduction electron-emitting devices are very preferable when used for the multiple electron beam source of a large screen image display apparatus that can produce bright images. Therefore, some surface conduction electron-emitting devices that can advantageously be used for the purpose of the invention will be described hereinafter in terms of basic configuration and manufacturing method.

(The Configurations of Preferable Surface Conduction Electron-Emitting Devices and Methods of Manufacturing Such Devices)

There are two types of surface conduction electron-emitting device comprising a pair of device electrodes where the electron-emitting region and its surrounding area are formed by a film of fine particles. They are a flat type and a step type.

(Flat Type Surface Conduction Electron-Emitting Device)

Firstly, a flat type surface conduction electron-emitting device will be described along with a method of manufacturing the same.

FIGS. 8A and 8B are schematic plan and sectional side views showing the basic configuration of a flat type surface conduction electron-emitting device. Referring to FIGS. 8A and 8B, the device comprises a substrate 1101, a pair of device electrodes 1102 and 1103, an electroconductive film 1104 including an electron-emitting region 1105 produced by means of electric forming operation and a thin film deposit 1113 formed by a current activation treatment.

The substrate 1101 may be a glass substrate of quartz glass, soda lime glass or some other type of glass, a ceramic substrate made of alumina or some other ceramic material or a substrate realized by forming an insulation layer of $SiO_2$ on any of the above listed substrates.

While the oppositely arranged device electrodes 1102 and 1103 may be made of any highly conducting material, preferred candidate materials include metals such as Ni, Cr, Au, Mo, W, Pt, Ti, Cu, Pd and Ag and their alloys, metal oxides such as $In_2O_3$—$SnO_2$, semiconductor materials such as polysilicon and other materials.

The device electrodes may be prepared by using in combination a film forming technique such as evaporation and a patterning technique such as photolithography or etching, although any other techniques (such as printing) may also be used. The device electrodes 1102 and 1103 may be formed to any appropriate shape that suits the application of the electron-emitting device. Generally speaking, the distance L separating the device electrodes 1102 and 1103 is normally between several hundred angstroms and several hundred micrometers and, preferably, between several micrometers and tens of several micrometers. The film thickness d of the device electrodes is between tens of several hundred angstroms and several micrometers.

The electroconductive thin film 1104 is preferably a fine particle film. The term "a fine particle film" as used herein refers to a thin film constituted of a large number of fine particles (including conglomerates such as islands). When microscopically observed, it will be found that the fine particles film normally has a structure where fine particles are loosely dispersed, tightly arranged or mutually and randomly overlapping.

The fine particles in the fine particle film has a diameter between several angstroms and several thousand angstroms and preferably between 10 angstroms and 200 angstroms. The thickness of the fine particle film is determined as a function of a number of factors as will be described hereinafter, including the requirement of electrically connecting itself to the device electrodes 1102 and 1103 in good condition, that of carrying out an electric forming operation as will be described hereinafter in good condition and that of making the electric resistance of the film conform to an appropriate value as will be described hereinafter. Specifically it is found several angstroms and several thousand angstroms and, preferably, between 10 angstroms and 500 angstroms.

Materials that can be used for the fine particle film include metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The electroconductive film 1104 is made of a fine particle film and normally shows a resistance per unit surface area (sheet resistance) between $10^3$ and $10^7$ [ohm/□].

The electroconductive film 1104 and the device electrodes 1102 and 1103 are arranged in a partly overlapped manner in order to secure good electric connection therebetween. While the substrate 1101, the device electrodes 1102 and 1103 and the electroconductive film 1104 are laid in the above order to a multilayer structure in FIGS. 8A and 8B, the electroconductive film 1104 may alternatively be arranged between the substrate 1101 and the device electrodes 1102, 1103.

The electron-emitting region 1105 is realized as part of the electroconductive thin film 1104 and it contains a gap or gaps and is electrically more resistive than the surrounding areas of the electroconductive film. It is produced as a result of an energization forming process as will be described hereinafter. The fissures may contain fine particles having a diameter between several angstroms and several hundred angstroms. The electron-emitting region is only schematically shown in FIGS. 8A and 8B because there is no way to accurately determine its position and shape.

The thin film 1113 formed by deposition is typically made of carbon or carbon compound and covers the electron-emitting region 1105 and its surrounding area. The thin film 1113 is formed by means of a current activation treatment conducted after the energization forming process as will be described hereinafter.

The thin film 1113 is made of monocrystalline graphite, polycrystalline graphite, amorphous carbon or a mixture of any of them. The film thickness of the thin film 1113 is less than 500 [angstroms], preferably less than 300 [angstroms]. The thin film 1113 is only schematically shown in FIGS. 8A and 8B because there is no way to accurately determine its position and shape.

In this embodiment, surface conduction electron-emitting devices having a preferable basic configuration as described above were prepared in a manner as described below.

The substrate 1101 is made of soda lime glass and the device electrodes 1102 and 1103 are made of a thin Ni film having a thickness d of 1,000 [angstoms] and separated from each other by a distance L of 2 [micrometers].

The fine particle film is principally made of Pd or PdO and has a film thickness of about 100 [angstroms] and a width W of 100 [micrometers].

Now, a method of manufacturing a flat type surface conduction electron-emitting device will be described. FIGS. 9A through 9E are schematic cross sectional views of a surface conduction electron-emitting device that can be used for the purpose of the invention, illustrating different manufacturing steps thereof. Note that the components that are same as those of FIGS. 8A and 8B are respectively denoted by the same reference symbols.

Figure 9A:
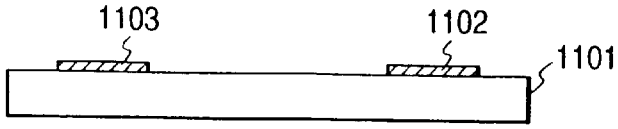
FIGS. 9A, 9B, 9C, 9D and 9E are cross sectional views of a flat-type surface conduction electron emitting device that can be used in any of the embodiments of the invention, illustrating different manufacturing steps thereof.

(1) Firstly, a pair of device electrodes 1102 and 1103 are formed on a substrate 1 as shown in FIG. 9A.

After thoroughly cleaning the substrate 1101 with a detergent, pure water and an organic solvent, the material of the device electrodes is formed on the insulating substrate by appropriate film deposition means using vacuum such as evaporation or sputtering and the deposited material is then etched to show a given pattern by photolithography etching in order to produce a pair of device electrodes (1102, 1103) as shown in FIG. 9A.

Figure 9B:
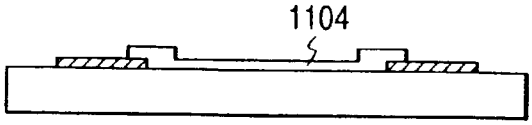
Figure 9C:
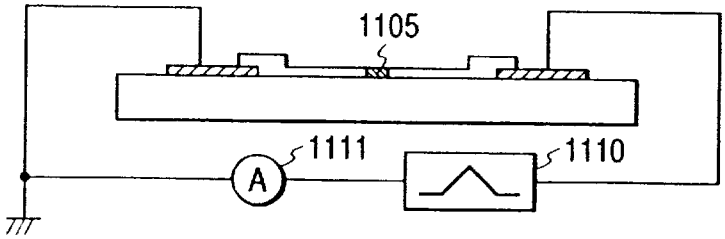

(2) Then, an electroconductive film 1104 is formed as shown in FIG. 9B.

More specifically, an organic metal solution is applied to the substrate of FIG. 9A and thereafter dried, heated and baked to produce a fine particle film, which is then etched to show a given pattern by photolithography etching. The organic metal solution is a solution of an organic compound containing as a principal ingredient thereof a metal with which an electroconductive film is formed on the substrate. In this embodiment, Pd is used for the principal ingredient. While a dipping technique can be used to apply the solution on the substrate, a spinner or a sprayer may alternatively be used.

Techniques for forming an electroconductive film of fine particles on the substrate include vacuum deposition, sputtering and chemical vapor phase deposition other than the above technique of applying an organic metal solution.

(3) Thereafter, an appropriate voltage is applied to the device electrodes 1102 and 1103 by an energization forming power source 1110 to carry out an energization forming operation on the electroconductive film and produce an electron-emitting region 1105 in the electroconductive film.

An energization forming operation is an operation with which the electroconductive film 1104 of fine particles is electrically energized and partly destroyed, deformed or changed to make it have a structure suitable for emitting electrons. A gap or gaps are appropriately formed in the structurally modified region suited to emit electrons (or electron-emitting region 1105). The electron-emitting region 1105 shows a large electric resistance if compared with that portion of the electroconductive film before it is produced when a voltage is applied between the device electrodes 1102 and 1103.

Figure 10:
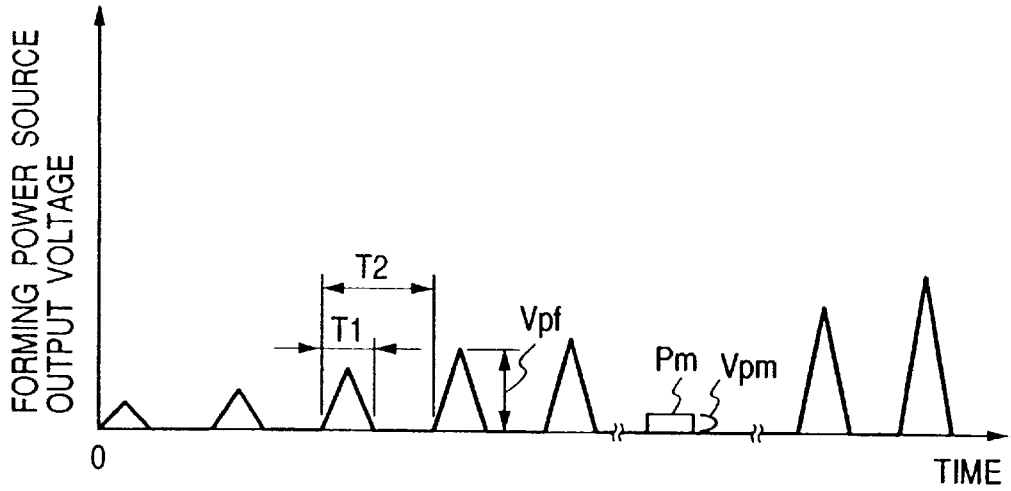
FIG. 10 is a graph showing the waveform of the voltage that can be applied in an energization forming process for the purpose of the invention.

The energization forming operation will now be described further by referring to FIG. 10 that illustrates a typical waveform of the voltage applied from the energization forming power source 1110. A pulse-shaped voltage is preferably used for the energization forming process of an electroconductive film of fine particles. A rising triangular pulse voltage showing triangular pulses with a rising pulse height Vpf as illustrated in FIG. 10 is preferably used for this embodiment, said triangular pulses having a width of T1 and appearing at regular intervals of T2. Additionally, a monitor pulse Pm is appropriately inserted in the above triangular pulses to detect the electric current produced by that pulse and hence the operation of the electron-emitting region 1105 by means of an ammeter 1111.

For this mode of carrying out the invention, a pulse width T1 of 1 [millisecond] and a pulse interval T2 of 10 [milliseconds] were used in a vacuum atmosphere of typically $1\times10^{-5}$ Torr. The height of the triangular pulses was raised by an increment of 0.1 [V] and a monitor pulse Pm is inserted for every five triangular pulses. The voltage of the monitor pulse Pm is set to 0.1 [V] so that it may not adversely affect the energization forming process. The energization forming operation is terminated when typically a resistance greater than $1\times10^6$ [ohms] is observed between the device electrodes 1102 and 1103 or the electric current detected by the ammeter 1111 when a monitor pulse is applied is less than $1\times10^{-7}$ [A].

Note that the above described numerical values for the energization forming process are cited only as examples and they may preferably and appropriately be modified when different values are selected for the thickness of the electroconductive film of fine particles the distance L separating the device electrodes and other design parameters.

(4) After the energization forming operation, the device may be subjected to a current activation process, where an appropriate voltage is applied between the device electrodes 1102 and 1103 from an activation power source 1112 to improve the electron emission characteristics of the device.

Figure 9D:
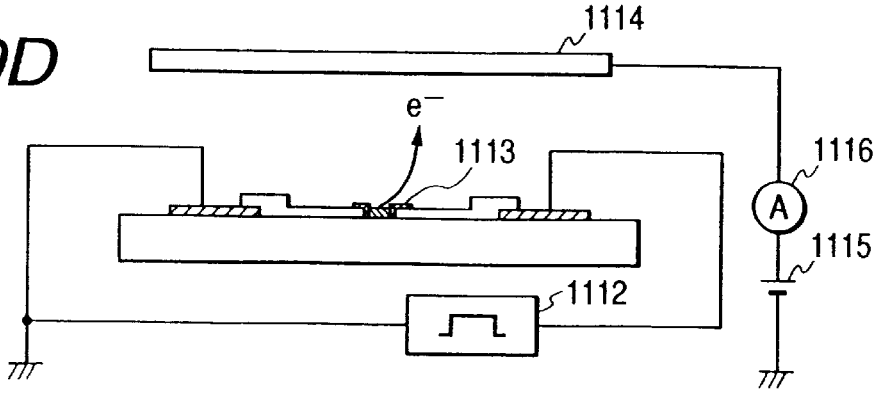

A current activation process is an operation where the electron-emitting region 1105 that has been produced as a result of the above energization forming operation is electrically energized once again until carbon or a carbon compound is deposited on and near that region. In FIG. 9D, the carbon or carbon compound deposits are only schematically illustrated. After the current activation process, the electron-emitting region of the device emits electrons at a rate more than 100 times greater than the rate of electron emission before the current activation process if a same voltage is applied.

More specifically, a pulse voltage is periodically applied to the device in vacuum of a degree between $10^{-4}$ and $10^{-5}$ [Torr] so that carbon or carbon compounds may be deposited on the device out of the organic substances existing in the vacuum. The deposit 1113 is typically made of monocrystalline graphite, polycrystalline graphite, amorphous carbon or a mixture of any of them and have a film thickness of less than 500 [angstroms], preferably less than 300 [angstroms].

Figure 11A:
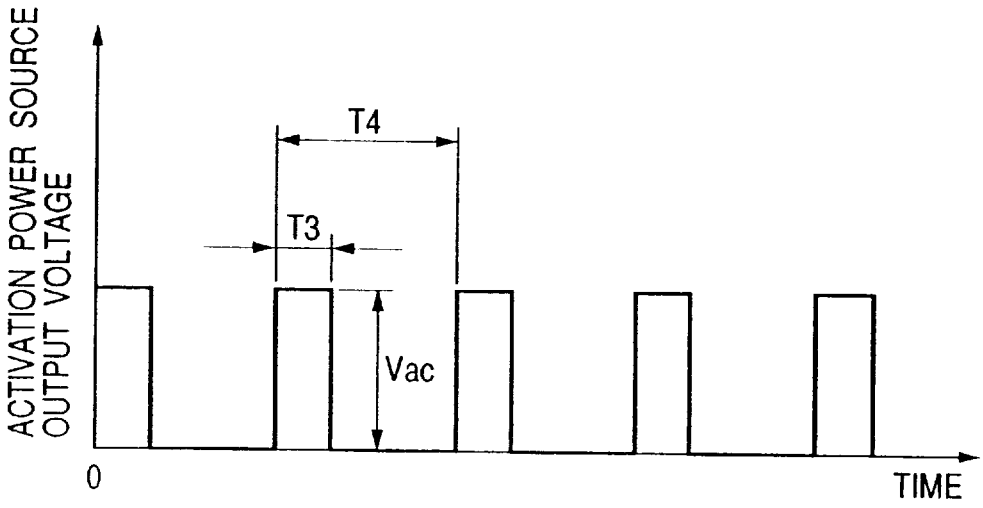
FIG. 11A is a graph showing the waveform of the voltage that can be applied in an energization activation process for the purpose of the invention.

FIG. 11A shows a typical waveform of the voltage applied from the activation power source 1112. In this mode of carrying out the invention, a rectangular pulse voltage having a constant height is periodically applied in the current activation process. The rectangular pulse voltage Vac is 14 [V] and the pulse wave has a pulse width T3 of 1 [millisecond] and a pulse interval T4 of 10 [milliseconds]. Note that the above described numerical values for the electric activation process are cited only as examples and they may preferably and appropriately be modified when the different values are selected for the design parameters of the surface conduction electron-emitting device.

Figure 11B:
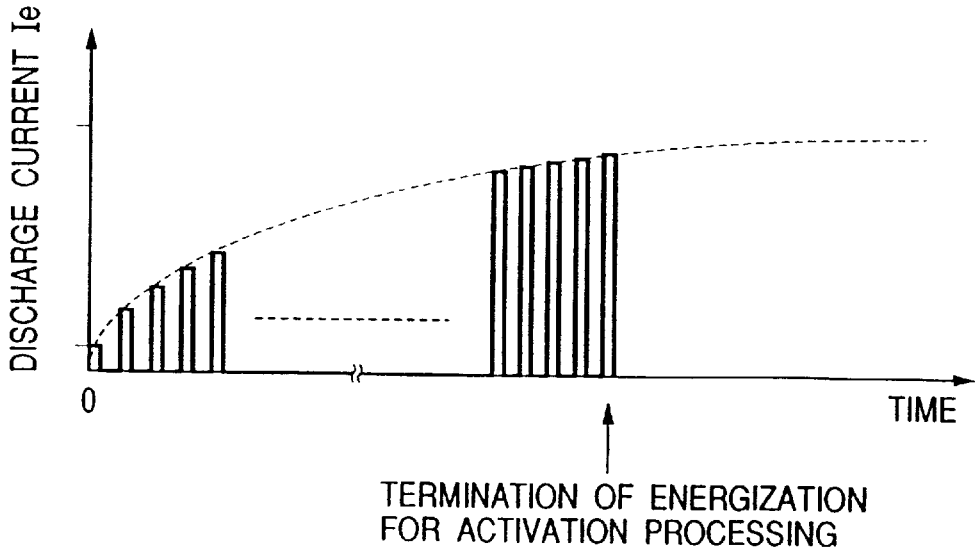
FIG. 11B is a graph showing the change with time of the emission current Ie that can be observed in an energization activation process.

In FIG. 9D, reference numeral 1114 denotes an anode for capturing the emission current Ie emitted from the surface conduction electron-emitting device, to which a DC high voltage power source 1115 and an ammeter 1116 are connected. If the activation process is carried out after the substrate 1 is mounted on the display panel, the fluorescent surface of the display panel may be used for the anode 1114. While a voltage is being applied from the activation power source 1112, the emission current Ie is observed by means of the ammeter 1116 to monitor the progress of the electric activation process so that the activation power source may be operated under control. FIG. 11B shows a typical behaviour with time of the emission current Ie observed by means of the ammeter 1116. As seen from FIG. 11B, although the emission current Ie increases with time in the initial stages of application of a pulse voltage, it eventually becomes saturated and stops increasing. Thus, the current activation process will be terminated by stopping the supply of power from the activation power source 1112 when the emission current Ie gets to a saturated level.

Note that the above described numerical values for the electric activation process are cited only as examples and they may preferably and appropriately be modified when the different values are selected for the design parameters of the surface conduction electron-emitting device.

Figure 9E:
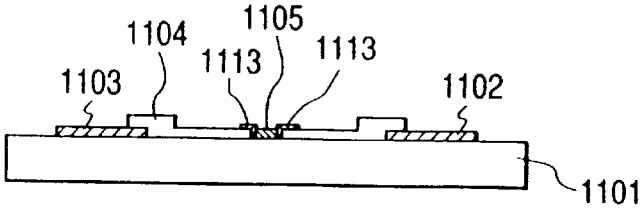

With the above manufacturing steps, a flat type surface condition electron-emitting device as shown in FIG. 9E and same as the one shown in FIGS. 8A and 8B is produced.

(Step Type Surface Conduction Electron-Emitting Device)

Now, a step type surface conduction electron-emitting device will be described along with a method of manufacturing the same as surface conduction electron-emitting device of another typical type.

Figure 12:
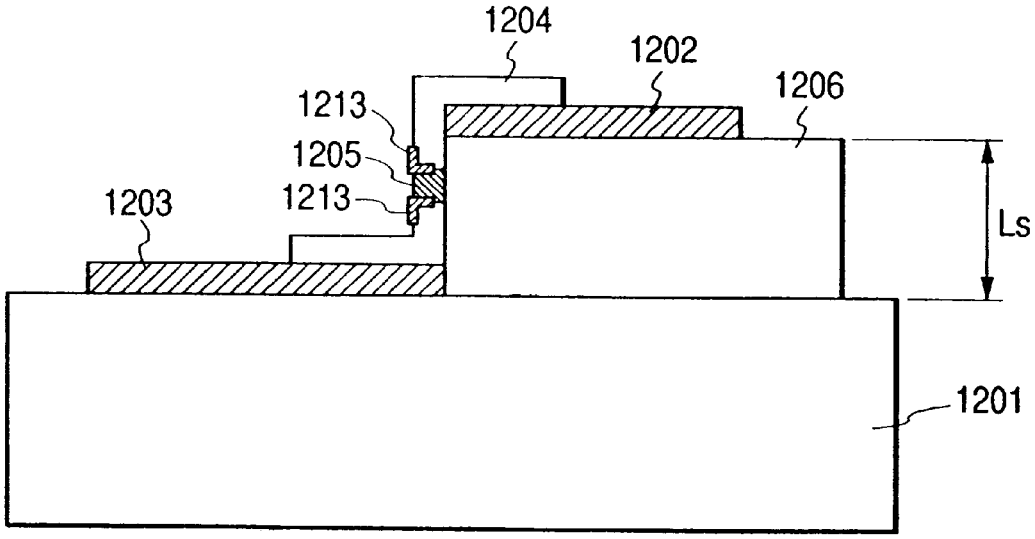
FIG. 12 is a schematic cross sectional view of a step-type surface conduction electron emitting device that can be used in any of the embodiments of the invention.

FIG. 12 is a schematic sectional side view showing the basic configuration of a step type surface conduction electron-emitting device. Referring to FIG. 12, the device comprises a substrate 1201, a pair of device electrodes 1202 and 1203, a step-forming section 1206, an electroconductive film 1204 of fine particles, an electron-emitting region 1205 produced by an energization forming process and a thin film 1213 formed by a current activation process.

A step type surface conduction electron-emitting device differs from a flat type device in that one of the device electrodes (electrode 1202) is arranged on the step-forming section 1206 and the electroconductive film 1204 covers a lateral side of the step-forming section 1206. Thus, the distance L separating the device electrodes of the flat type surface conduction electron-emitting device of FIGS. 8A and 8B corresponds to the height Ls of the step of the step-forming section 1206 of a step type surface conduction electron-emitting device. Note that the materials described above for a flat type surface conduction electron-emitting device may also be used for the substrate 1201, the device electrodes 1202 and 1203 and the electroconductive film 1204 of fine particles of a step type surface conduction electron-emitting device. The step-forming section 1206 is typically made of an insulating material such as $SiO_2$.

A method of manufacturing a step type surface conduction electron-emitting device will be described below by referring to FIGS. 13A through 13F. Reference numerals in FIGS. 13A through 13F are same as those used in FIG. 12.

Figure 13A:
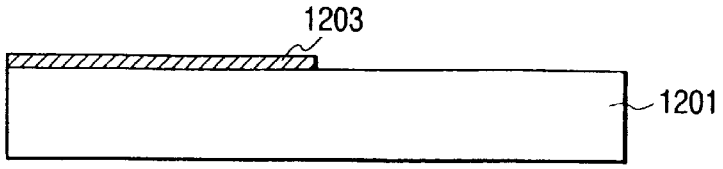
FIGS. 13A, 13B, 13C, 13D, 13E and 13F are cross sectional views of a step-type surface conduction electron emitting device that can be used in any of the embodiments of the invention, illustrating different manufacturing steps thereof.

(1) A device electrode 1203 is formed on a substrate 1201 as shown in FIG. 13A.

Figure 13B:
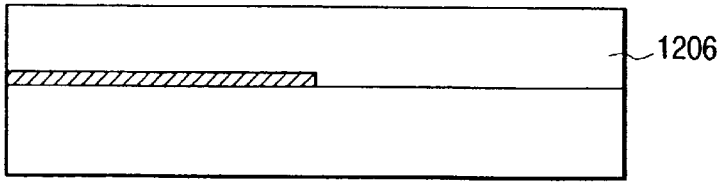

(2) Then, an insulation layer is laid on the substrate 1201 to produce a step-forming section as shown in FIG. 13B. The insulation layer may be made of $SiO_2$ by appropriate means selected from sputtering, vacuum deposition, printing and other film forming techniques.

Figure 13C:
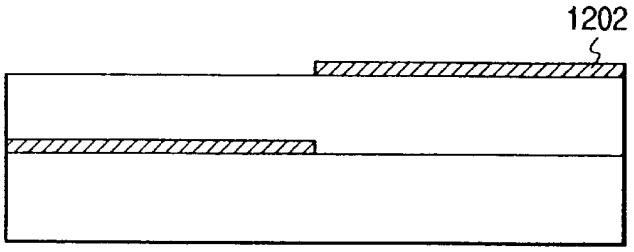

(3) Thereafter, another device electrode 1203 is formed on the insulation layer as shown in FIG. 13C.

Figure 13D:
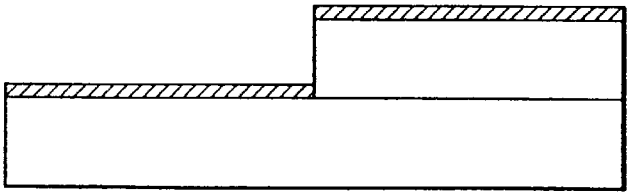

(4) Subsequently, the insulation layer is partly removed typically by etching to expose the device electrode 1203 as shown in FIG. 13D.

Figure 13E:
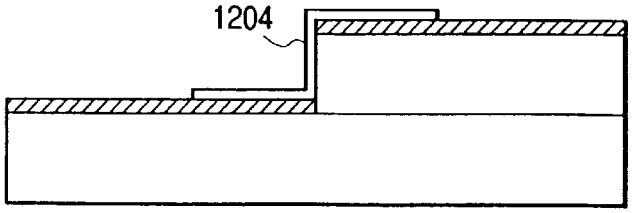

(5) Then, an electroconductive film 1204 of fine particles is formed as shown in FIG. 13E. The electroconductive film may be prepared typically by application as in the case of a flat type surface conduction electron-emitting device.

(6) Thereafter, like the case of a flat type surface conduction electron-emitting device, the device is subjected to an electric forming process to produce an electron-emitting region. This can be done by using the arrangement of FIG. 9C described earlier by referring to a flat type surface conduction electron-emitting device.

(7) Finally, as in the case of a flat type surface conduction electron-emitting device, the device may be subjected to an electric activation process to deposit carbon or a carbon compound near the electron-emitting region. If such is the case, the arrangement of FIG. 9D described earlier by referring to a flat type surface conduction electron-emitting device can be used.

Figure 13F:
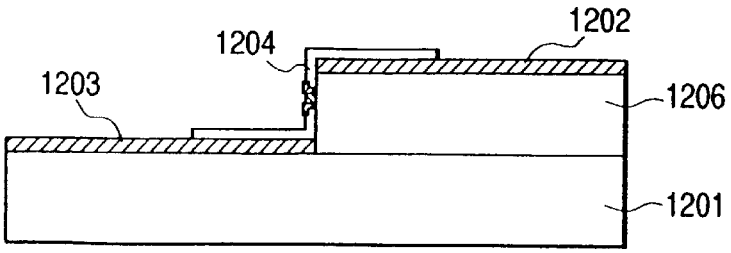

With the above manufacturing steps, a step type surface conduction electron-emitting device as shown in FIG. 13F that is same as the one shown in FIG. 12 is produced.

(Characteristic Features of a Surface Conduction Electron-Emitting Device used for an Image Display Apparatus)

Now, some of the basic features of an electron-emitting device according to the invention and prepared in the above described manner will be described below when it is used for an image display apparatus.

Figure 14:
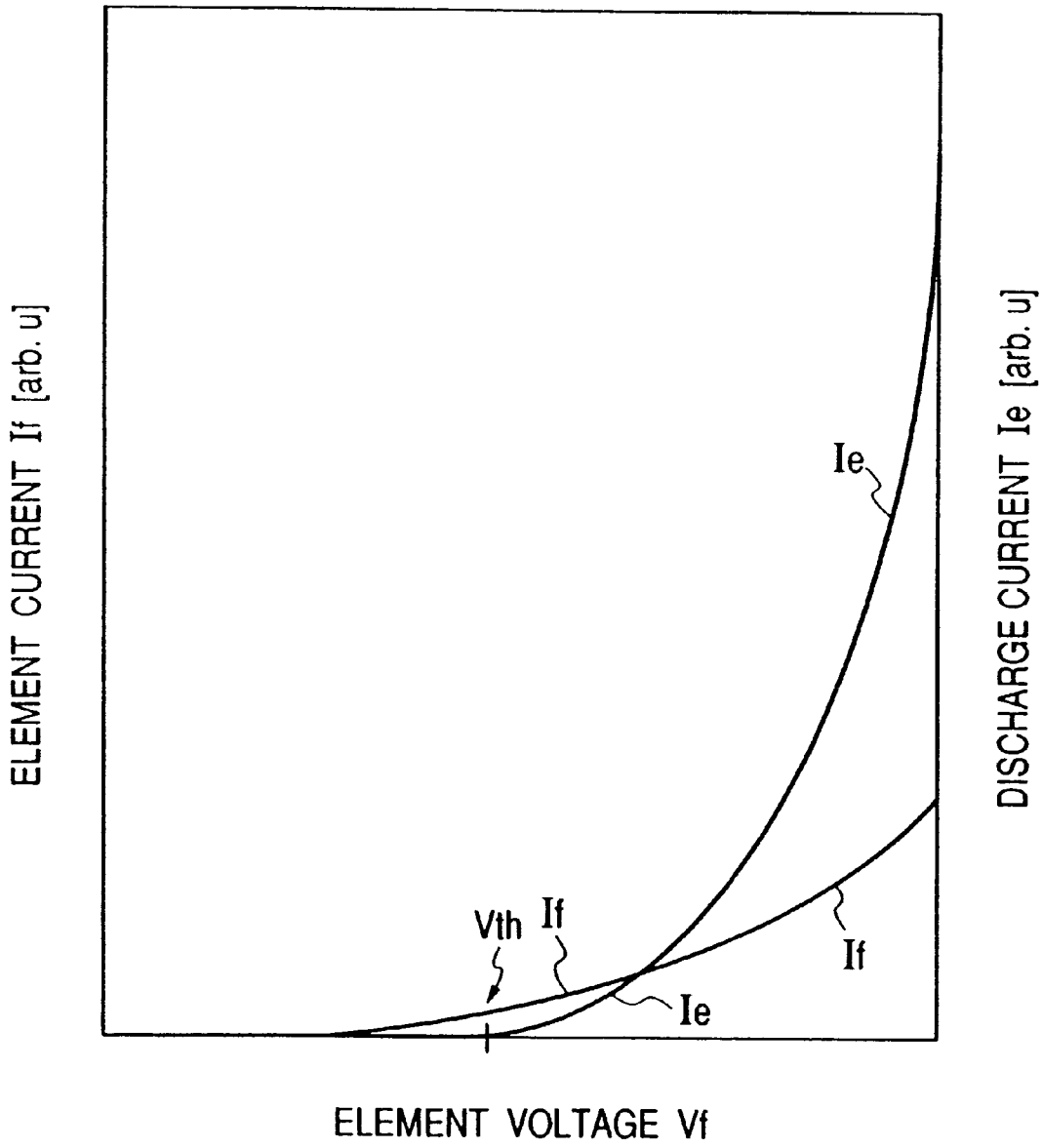
FIG. 14 is a graph showing a typical performance of a surface conduction electron emitting device that can be used in any of the embodiments of the invention.

FIG. 14 shows a graph schematically illustrating the relationships between the (emission current Ie) and the (device-applied voltage VF) and between the (device current If) and the (device-applied voltage Vf) of a surface conduction electron-emitting device when used for an image display apparatus. Note that different units are arbitrarily selected for Ie and If in FIG. 14 in view of the fact that the emission current Ie has a magnitude by far smaller than that of the device current If and the performance of the device can vary remarkably by changing the design parameters.

An electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage Vth), whereas the emission current Ie is practically undetectable when the applied voltage is found lower than the threshold voltage Vth.

Differently stated, an electron-emitting device according to the invention is a non-linear device having a clear threshold voltage Vth to the emission current Ie.

Secondly, since the emission current Ie is highly dependent on the device voltage Vf, the former can be effectively controlled by way of the latter.

Thirdly, the electric charge of the electrons emitted from the device can be controlled as a function of the duraton of time of application of the device voltage Vf because the emission current Ie produced by the electrons emitted from the device responds very quickly to the voltage Vf applied to the device.

Because of the above remarkable features, it will be understood that surface conduction electron-emitting devices according to the invention can suitable be used for image display apparatuses. By utilizing the first characteristic feature, an image can be displayed on the display screen by sequentially scanning the screen. More specifically, a voltage higher than the threshold voltage Vth is applied to a device to be driven to emit electrons as a function of the desired brightness, whereas a voltage lower than the threshold is applied to a device to be driven so as not to emit electrons. In this way, all the devices of the display apparatus are sequentially driven to scan the display screen and display an image.

Additionally, but utilizing the second or the third characteristic feature, the brightness of each device can be controlled to consequently control the color tone of the image being displayed.

(Structure of a Multi-Electron Beam Source Comprising a Multiple of Devices Arranged with a Simple Matrix Wiring Arrangement)

Now, the structure of a multi-electron beam source comprising a multiple of surface conduction electron-emitting devices arranged on a substrate with a simple matrix wiring arrangement will be described.

FIG. 2 is a schematic plan view of the multi-electron beam source used in the display panel of FIG. 1. A number of surface conduction electron-emitting devices similar to the one illustrated in FIGS. 8A and 8B are arranged on a substrate and connected to row-directional wiring electrodes 1003 and column-directional wiring electrodes 1004 to show a simple matrix arrangement. An insulation layer (not shown) is arranged between the row-directional wiring electrodes 1003 and the column-directional wiring electrodes 1004 at the crossings thereof to establish electron isolation.

FIG. 3 is a schematic cross sectional view of the multi-electron beam source of FIG. 2 taken along lines 3—3 of FIG. 2.

Note that the multi-electron beam source having a configuration as described above is prepared by arranging row-directional wiring electrodes 1013, column-directional wiring electrodes 1014, an inter-electrode insulation layer (not shown) on a substrate along with the device electrodes and the electroconductive thin films of surface conduction electron-emitting devices and subsequently supplying electric power to the devices by way of the row-directional wiring electrodes 1013 and the column-directional wiring electrodes 1014 for an energization forming process and a current activation process.

(3) Configuration of Drive Circuit (and Method of Driving the Same)

Figure 15:
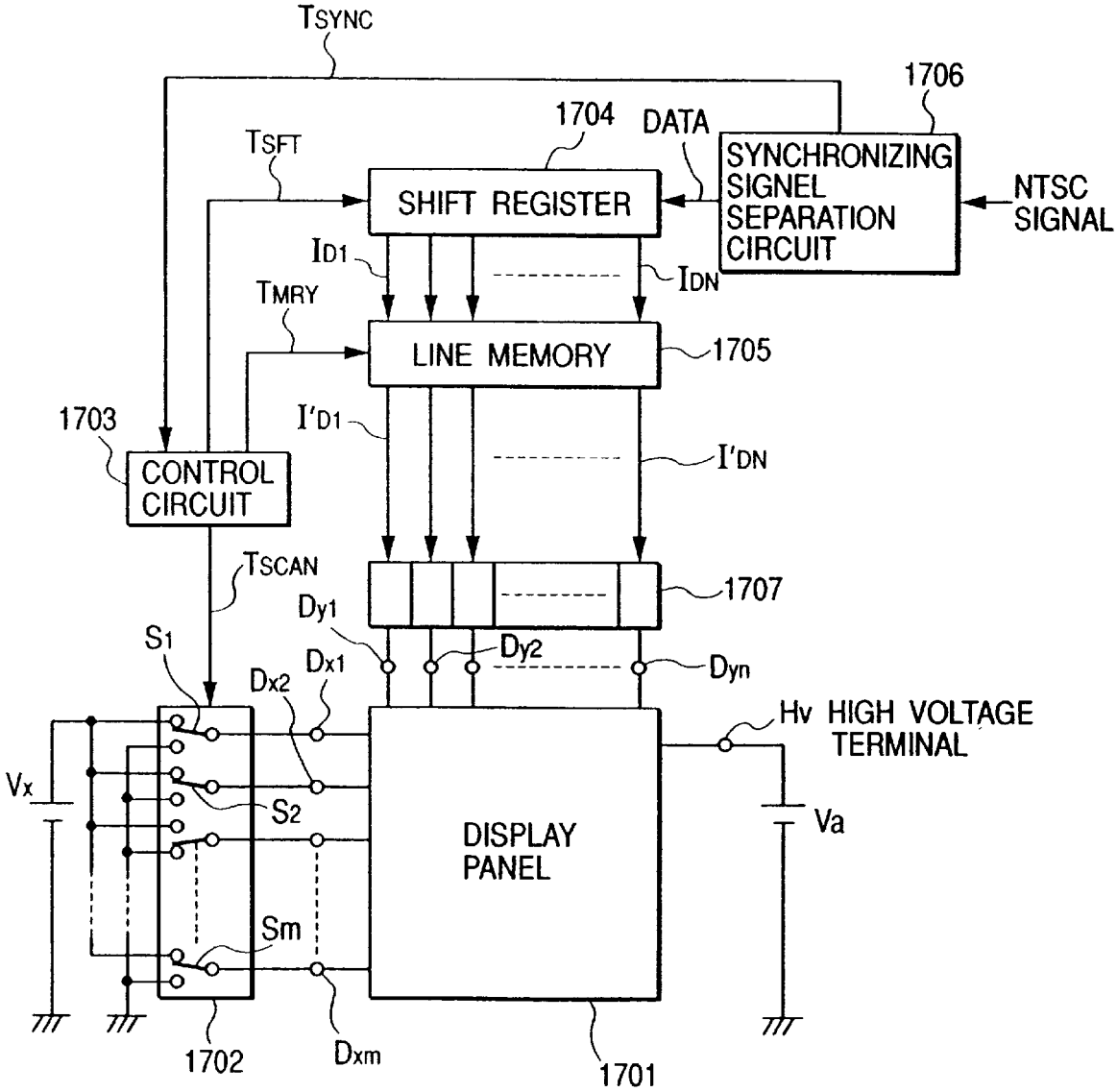
FIG. 15 is a schematic block diagram of a drive circuit to be used for an image-forming apparatus, schematically showing its configuration.

FIG. 15 is a block diagram of a drive circuit for displaying television images according to NTSC television signals. In FIG. 15, reference numeral 1701 denotes display panel prepared in a manner as described above. Scan circuit 1702 operates to scan display lines whereas control circuit 1703 generates input signals to be fed to the scan circuit. Shift register 1704 shifts data for each line and line memory 1705 feeds modulation signal generator 1707 with data for a line. Synchronizing signal separation circuit 1706 separates a synchronizing signal from an incoming NTSC signal.

Each component of the apparatus of FIG. 15 operates in a manner as described below in detail.

The display panel 1701 is connected to external circuits via terminals Dx1 through Dxm, Doy1 through Dyn and high voltage terminal Hv, of which the terminals Dx1 thorough Dxm are designed to receive scan signals for sequentially driving on a one-by-one basis the rows (of n devices) of a multi-electron beam source in the display panel 1701 comprising a number of surface-conduction type electron-emitting devices arranged in the form of a matrix having m rows and n columns. On the other hand, the terminals Dy1 through Dyn are designed to receive a modulation signal for controlling the output electron beam of each of the surface-conduction electron-emitting devices of a row selected by a scan signal. The high voltage terminal Hv is fed by a DC voltage source Va with a DC voltage of a level typically around 5 [kV], which is sufficiently high to energize the fluorescent bodies by way of electrons emitted from the multi-electron beam source.

The scan circuit 1702 operates in a manner as follows. The circuit comprises n switching devices (of which only devices S1 and Sm are schematically shown in FIG. 15), each of which takes either the output voltage of the DC voltage source Vx or 0 [V] (the ground voltage) and comes to be connected with one of the terminals Dx1 through Dxm of the display panel 1701. Each of the switching devices S1 through Sm operates in accordance with control signal Tscan fed from the control circuit 1703 and can be prepared by combining transistors such as FETs. The DC voltage source Vx is designed to output a constant voltage so that any drive voltage applied to devices that are not being scanned is reduced to less than threshold voltage Vth as described earlier by referring to FIG. 14.

The control circuit 1703 coordinates the operations of related components so that images may be appropriately displayed in accordance with externally fed video signals. It generates control signals Tscan, Tsft and Tmry in response to synchronizing signal Tsync fed from the synchronizing signal separation circuit 1706, which will be described below. The synchronizing signal separation circuit 1706 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 1706 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 1704, is designed as DATA signal.

The shift register 1704 carries out for each line a serial/parallel conversion on DATA signals that are serially fed on a time series basis in accordance with control signal Tsft fed from the control circuit 1703. In other words, a control signal Tsft operates as a shift clock for the shift register 1704. A set of data for a line that have undergone a serial-parallel conversion (and correspond to a set of drive data for n electron-emitting devices) are sent out of the shift register 1704 as n parallel signals Id1 through Idn.

Line memory 1705 is a memory for storing a set of data for a line, which are signals Id1 through Idn, for a required period of time according to control signal Tmry coming from the control circuit 1703. The stored data are sent out as I'd1 through I'dn and fed to modulation signal generator 1707.

Said modulation signal generator 1707 is in fact a signal source that appropriately drives and modulates the operation of each of the surface-conduction type electron-emitting devices and output signals of this device are fed to the surface-conduction type electron-emitting devices in the display panel 1701 via terminals Doy1 through Doyn.

As described above by referring to FIG. 14, a surface conduction electron-emitting device according to the present invention is characterized by the following features in terms of emission current Ie. Firstly, as seen in FIG. 14, there exists a clear threshold voltage Vth (8 [V] for the electron-emitting devices of the embodiment that will be described hereinafter) and the device emit electrons only a voltage exceeding Vth is applied thereto. Secondly, the level of emission current Ie changes as a function of the change in the applied voltage above the threshold level Vth also as shown in FIG. 14, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level of the pulse-shaped voltage. Additionally, the total amount of electric charge of an electron beam can be controlled by varying the pulse width.

Thus, either modulation method or pulse width modulation may be used for modulating an electron-emitting device in response to an input signal. With voltage modulation, a voltage modulation type circuit is used for the modulation signal generator 1707 so that the peak level of the pulse shaped voltage is modulated according to input data, while the pulse width is held constant. With pulse width modulation, on the other hand, a pulse width modulation type circuit is used for the modulation signal generator 1707 so that the pulse width of the applied voltage may be modulated according to input data, while the peak level of the applied voltage is held constant.

Although it is not particularly mentioned above, the shift register 1704 and the line memory 1705 may be either of digital or of analog signal type so long as serial/parallel conversions and storage of video signals are conducted at a given rate.

If digital signal type devices are used, output signal DATA of the synchronizing signal separation circuit 1706 needs to be digitized. However, such conversion can be easily carried out by arranging an A/D converter at the output of the synchronizing signal separation circuit 1706. It may be needles to say that different circuits may be used for the modulation signal generator 1707 depending on if output signals of the line memory 115 are digital signals or analog signals. If digital signals are used, a D/A converter circuit of a known type may be used for the modulation signal generator 1707 and an amplifier circuit may additionally be used, if necessary. As for pulse width modulation, the modulation signal generator 1707 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 1707 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus having a configuration as described above, to which the present invention is applicable, the electron-emitting devices emit electrons as a voltage is applied thereto by way of the external terminals Dx1 through Dxm and Dy1 through Dyn. Then, the generated electron beams are accelerated by applying a high voltage to the metal back 1019 or a transparent electrode (not shown) by way of the high voltage terminal Hv. The accelerated electrons eventually collid with the fluorescent film 1018, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

(4) Application of Drive Circuit and Drive Method

Figure 16:
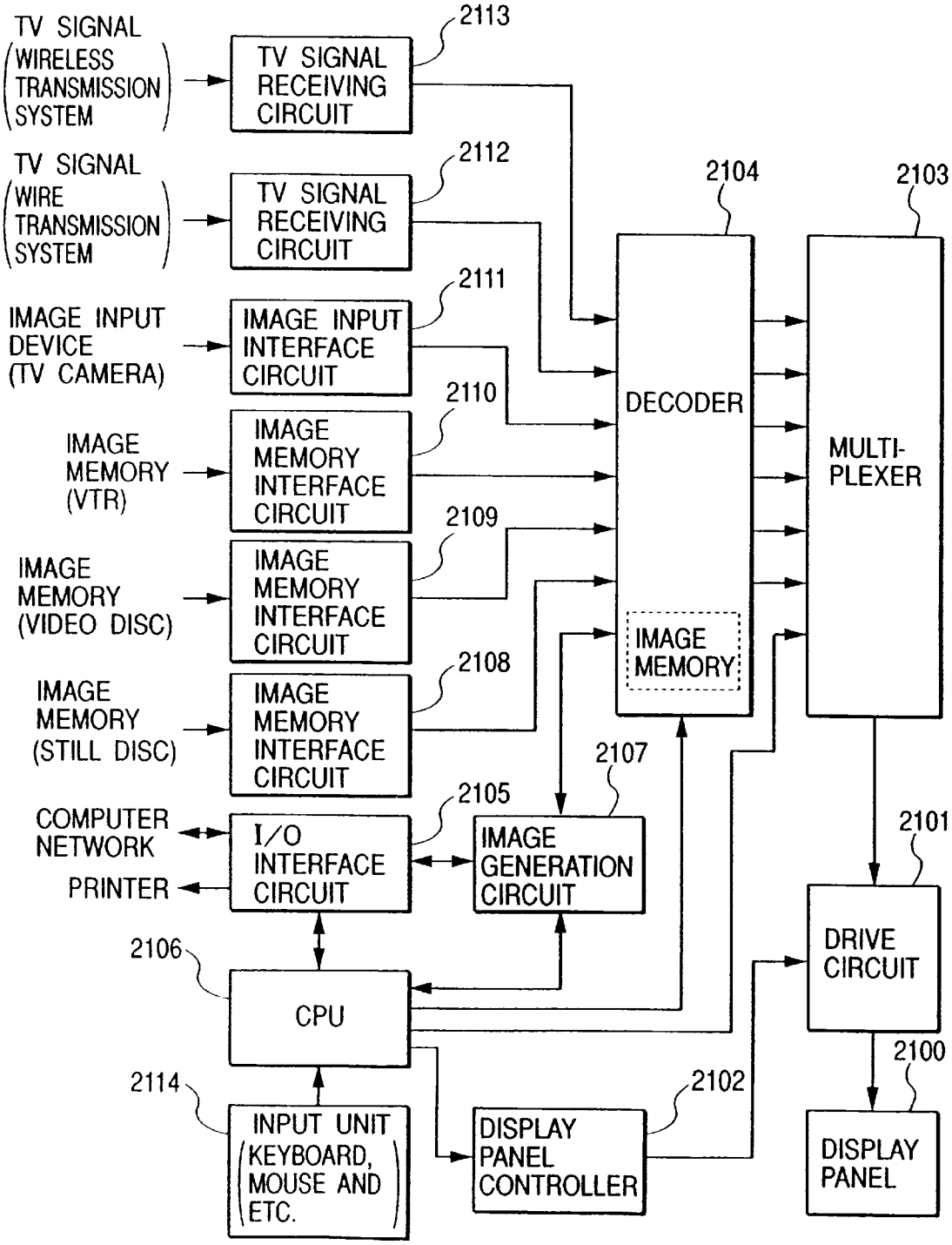
FIG. 16 is a schematic block diagram of a multi-functional image-forming apparatus incorporating an image-forming apparatus according to the invention.

FIG. 16 is a block diagram of a display apparatus realized by using an image forming apparatus comprising of an electron beam source containing surface conduction electron-emitting devices and adapted to provide visual information coming from a variety of sources of information including television transmission and other image sources.

In FIG. 16, there are shown a display panel 2100 comprising an electron beam source as described above by referring to the above embodiments, a display panel drive circuit 2101, a display panel controller 2102, a multiplexer 2103, a decoder 2104, an input/output interface circuit 2105, a CPU 2106, an image generator 2107, image input memory interface circuits 2108, 2109 and 2110, an image input interface circuit 2111, TV signal reception circuits 2112 and 2113 and an input unit 2114.

If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image signals therethrough.

Firstly, the TV signal reception circuit 2113 is a circuit for receiving TV image signals transmitted via a wireless transmission system using electromagnetic waves and/or spatial optical telecommunication networks. The TV signal system to be received is not limited to a particular one and any system such as NTSC, PAL or SECAM may feasibly be used with it. It is particularly suited for TV signals involving a larger number of scanning lines typically of a high definition TV system such as the MUSE system because it can be used for a large display panel comprising a large number of pixels. The TV signals received by the TV signal reception circuit 2103 are forwarded to the decoder 2104.

Secondly, the TV signal reception circuit 2112 is a circuit for receiving TV image signals transmitted via a wired transmission system using coaxial cables and/or optical fibers. Like the TV signal reception circuit 2113, the TV signal system to be used is not limited to a particular one and the TV signals received by the circuit are forwarded to the decoder 2104.

The image input interface circuit 2111 is a circuit for receiving image signals forward from an image input device such as a TV camera or an image pick-up scanner. It also forwards the received image signals to the decoder 2104.

The image input memory interface circuit 2110 is a circuit for retrieving image signals stored in a video tape recorder (hereinafter referred to as VTR) and the retrieved image signals are also forwarded to the decoder 2104.

The image input memory interface circuit 2109 is a circuit for retrieving image signals stored in a video disc and the retrieved image signals are also forwarded to the decoder 2104.

The image input memory interface circuit 2108 is a circuit for retrieving image signals stored in a device for storing still image data such as so-called still disc and the retrieved image signals are also forwarded to the decoder 2104.

The input/ouput interface circuit 2105 is a circuit for connecting the display apparatus and an external output signal source such as a computer, a computer network or a printer. It carries out input/ouput operations for image data and data on characters and graphics and, if appropriate, for control signals and numerical data between the CPU 2106 of the display apparatus and an external output signal source.

The image generation circuit 2107 is a circuit for generating image data to be displayed on the display screen on the basis of the image data and the data on characters and graphics input from an external output signal source via the input/output interface circuit 2105 or those combining from the CPU 2106. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 2107 for display are sent to the decoder 2104 and, if appropriate, they may also be sent to an external circuit such as a computer network or a printer via the input/output interface circuit 2105.

The CPU 2106 controls the display apparatus and carries out the operation of generating, selecting and editing images to be displayed on the display screen.

For example, the CPU 2106 sends control signals to the multiplexer 2103 and appropriately selects or combines signals for images to be displayed on the display screen. At the same time it generates control signals for the display panel controller 2102 and controls the operation of the display apparatus in terms of image display frequency, scanning method (e.g., interlaced scanning or non-interlaced scanning), the number of scanning lines per frame and so on.

The CPU 2106 also sends out image data and data on characters and graphics directly to the image generation circuit 2017 and accesses external computers and memories via the input/output interface circuit 2015 to obtain external image data and data on characters and graphics.

The CPU 2106 may additionally be so designed as to participate in other operations of the display apparatus including the operation of generating and processing data like the CPU of a personal computer or a word processor.

The CPU 2106 may also be connected to an external computer network via the input/output interface circuit 2105 to carry out computations and other operations, cooperating therewith.

The input unit 2114 is used for forwarding the instructions, programs and data given to it by the operator to the CPU 2106. As a matter of fact, it may be selected from a variety of input devices such as keyboards, mice, joysticks, bar code readers and voice recognition devices as well as any combinations thereof.

The decoder 2104 is a circuit for converting various image signals input via said circuits 2107 through 2113 back into signals for three primary colors, luminance signals and I and Q signals. Preferably, the decoder 2104 comprises image memories as indicated by a dotted line in FIG. 30 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 2104 in cooperation with the image generation circuit 2107 and the CPU 2106.

The multiplexer 2103 is used to appropriately select images to be displaced on the display screen according to control signals given by the CPU 2106. In other words, the multiplexer 2103 selects certain converted image signals coming from the decoder 2104 and sends them to the drive circuit 2101. It can also divide the display screen in a plurality of frames to display different images simultaneouslyby switching from a set of image signals to a different set of image signals within the time period for displaying a single frame.

The display panel controller 2102 is a circuit for controlling the operation of the drive circuit 2101 according to control signals transmitted from the CPU 2106.

Among others, it operates to transmit signals to the drive circuit 2101 for controlling the sequence of operations of the power source (not shown) for driving the display panel 2100 in order to define the basic operation of the display panel 2100.

It also transmits signals to the drive circuit 2101 for controlling the image display frequency and the scanning method (e.g., interlaced scanning or non-interlaced scanning) in order to define the mode of driving the display panel 2100.

If appropriate, it also transmits signals to the drive circuit 2101 for controlling the quality of the images to be displayed on the display screen in terms of luminance, contrast, color tone and sharpness.

The drive circuit 2101 is a circuit for generating drive signals to be applied to the display panel 2100. It operates according to image signals coming from said multiplexer 2103 and control signals coming from the display panel controller 2102.

A display apparatus according to the invention and having a configuration as described above and illustrated in FIG. 16 can display on the display panel 2100 various images given from a variety of image data sources.

More specifically, image signals such as television image signals are converted back by the decoder 2104 and then selected by the multiplexer 2103 before sent to the drive circuit 2101. On the other hand, the display controller 2102 generates control signals for controlling the operation of the drive circuit 2101 according to the image signals for the images to be displayed on the display panel 2100. The drive circuit 2101 then applies drive signals to the display panel 2100 according to the image signals and the control signals.

Thus, images are displayed on the display panel 2100. All the above described operations are controlled by the CPU 2106 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 2104, the image generation circuit 2107 and the CPU 2106 participate in such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commerical applications because it can operate as a display apparatus for television broadcasting, as a terminal apparatus for video teleconferencing, as an editing apparatus for still and movie pictures, as a terminal apparatus for a computer system, as a OA apparatus such as a word processor, as a game machine and in many other ways.

It may be needless to say that FIG. 16 shows only an example of possible configuration of a display apparatus comprising a display panel provided with an electron source prepared by arranging a number of surface conduction electron-emitting devices and the present invention is not limited thereto. For example, some of the circuit components of FIG. 16 may be omitted or additional components may be arranged there depending on the application. To the contrary, if a display apparatus according to the invention is used for visual telephone, it may be appropriately made to comprise additional components such as a television camera, a microphone, lighting equipment and transmission/reception circuits including a modem.

Since the display panel 201 of the image forming apparatus of this example can be realized with a remarkably reduced depth, the entire apparatus can be made very flat. Additionally, since the display panel can provide very bright images and a wide viewing angle, it produces very exciting sensations in the viewer to make him or her feel as if he or she were really present in the scene.

Embodiment 2

A second embodiment of this invention will be described only in terms of difference between it and Ebodiment 1.

Figure 17:
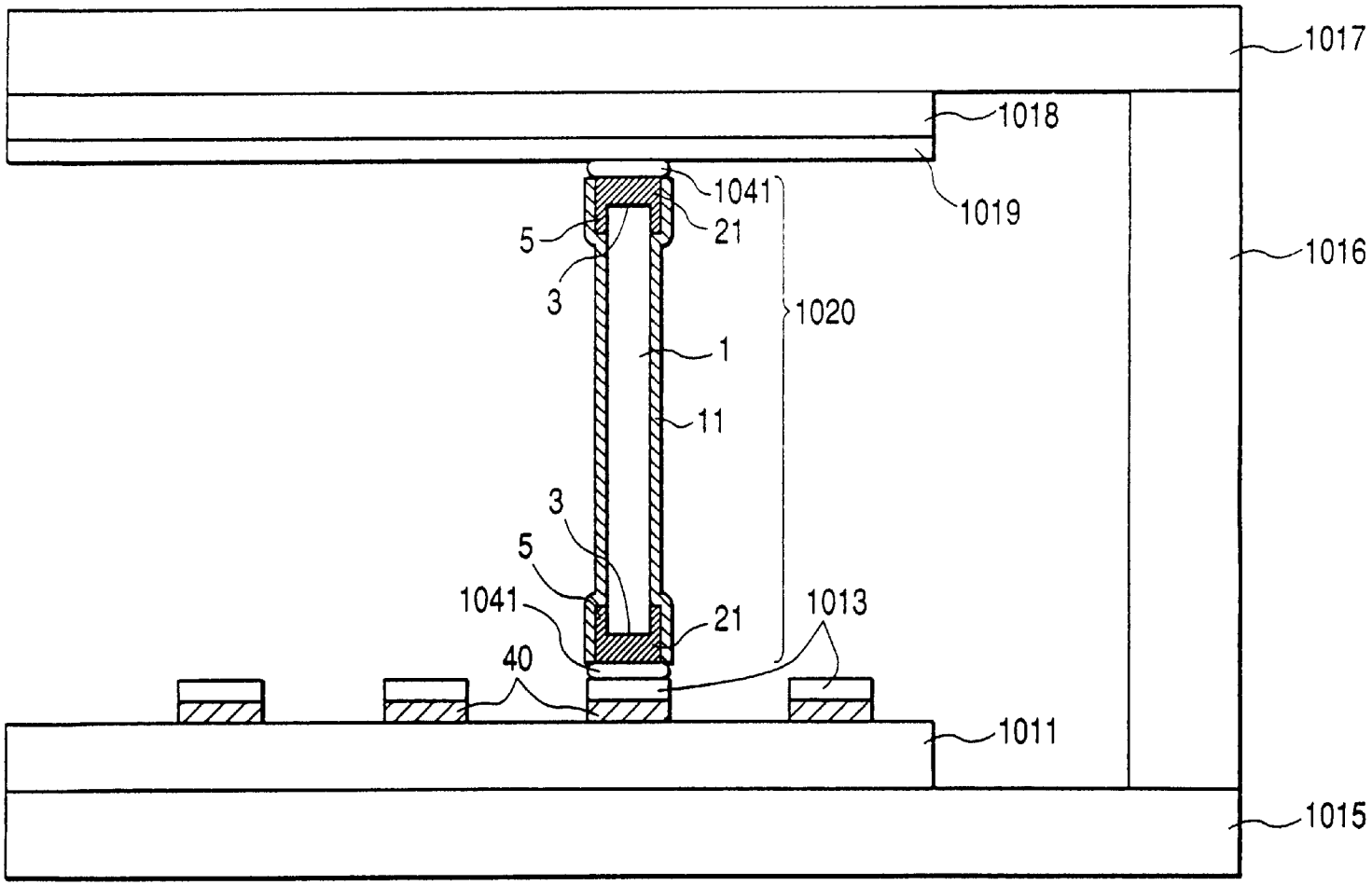
FIG. 17 is a schematic plan view of the substrate of a multi-electron beam source of an embodiment of the invention.

FIG. 17 is a schematic cross sectional view taken along lines 6—6 in FIG. 1 and the reference numbers same as those of FIG. 6 are used there. This embodiment differs from Embodiment 1 of FIG. 6 in that a high resistance film 11 is formed on the entire area of the insulating member 1 and the low resistance layer 21 that is otherwise exposed to ambient air. As in FIG. 6, the spacer 1020 comprises an insulating member 1, a high resistance film 11 for coating the insulating member 1, the bottoms 3 of the insulating memeber 1 and the lateral sides 5 of the insulating member 1. The electrocoductive bonding agent 1041 is not covered by the high resistance film 11 because it does not operate as component of the spacer 1020 but bonded to a row electrode 1013 and the metal back 1019. With this arrangement, the creeping discharge withstand voltage of the spacer is further improved because the low resistance layer 21 is not exposed to ambient air.

Embodiment 3

A third embodiment will be described only in terms of differences between it and Embodiment 1.

Figure 18:
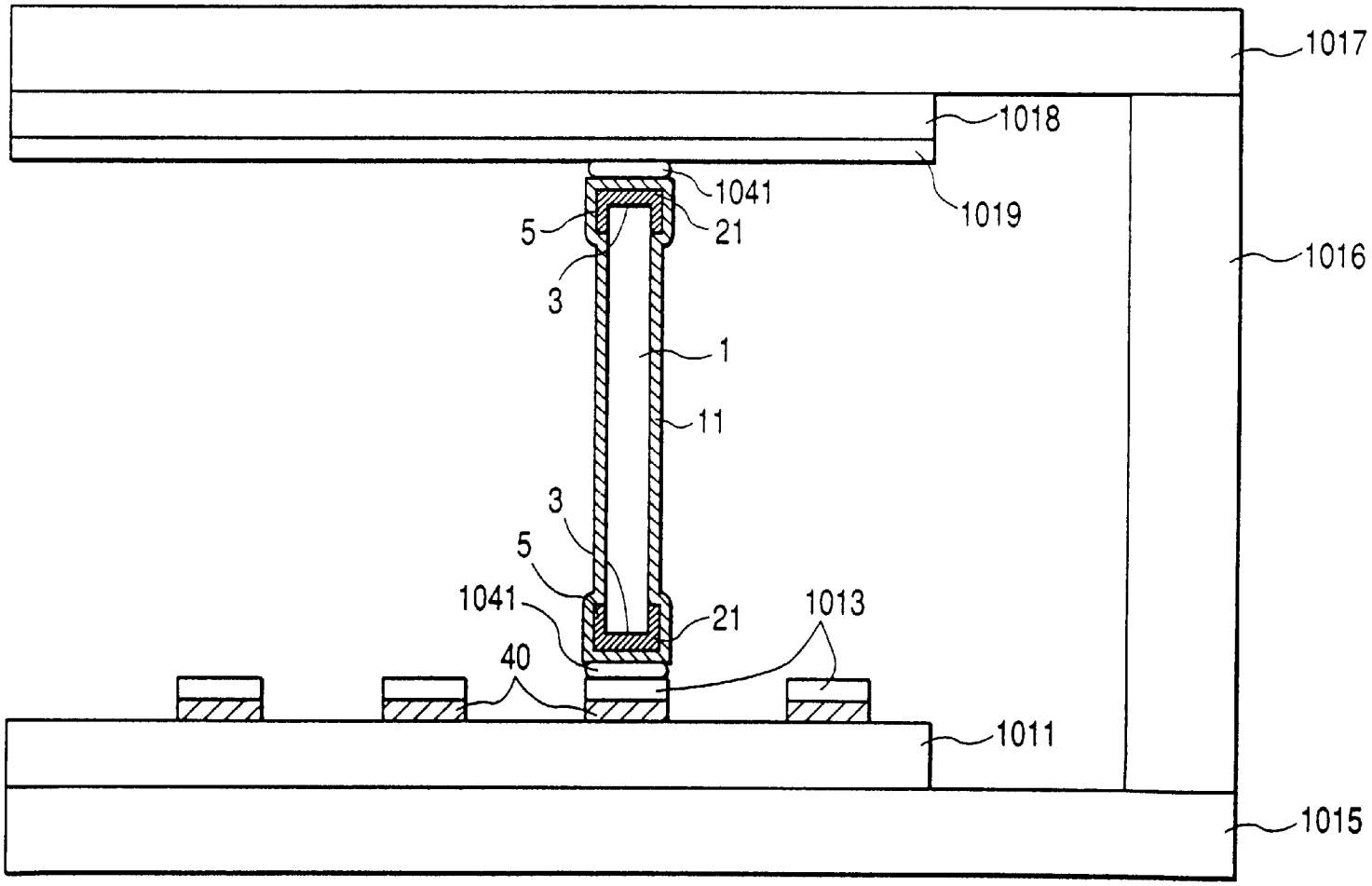
FIG. 18 is a schematic cross sectional view of the multi-electron beam source of FIG. 17.
Figure 19:
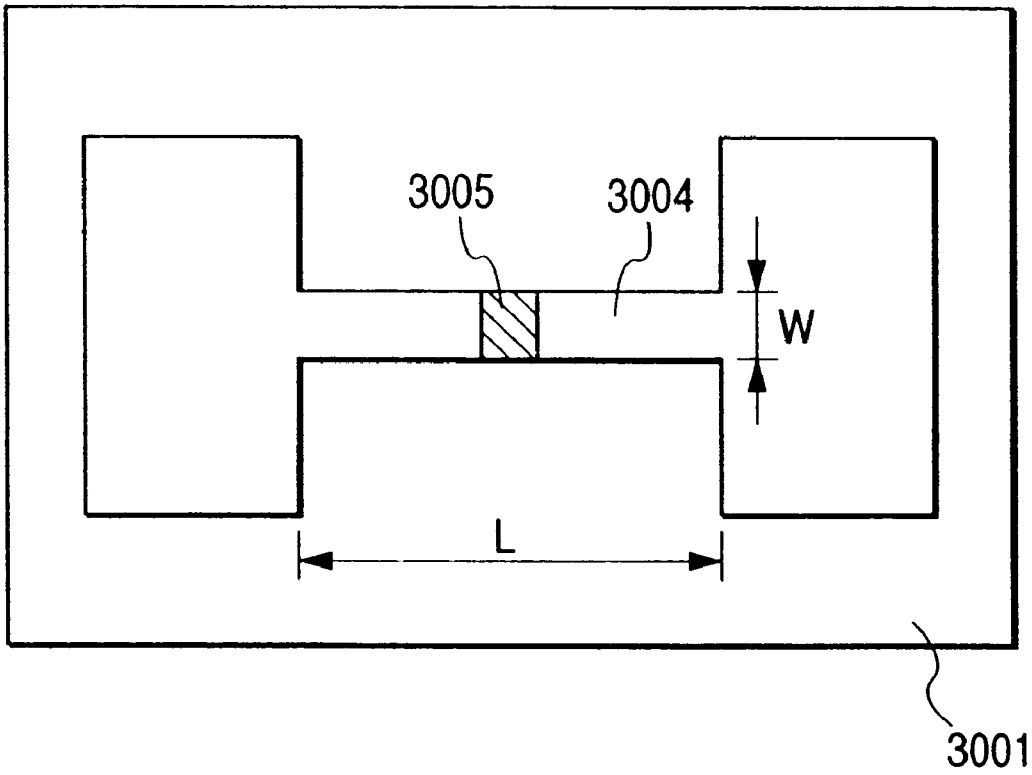
FIG. 19 PRIOR ART
FIG. 19 is a schematic plan view of a known surface conduction electron emitting device.
Figure 20:
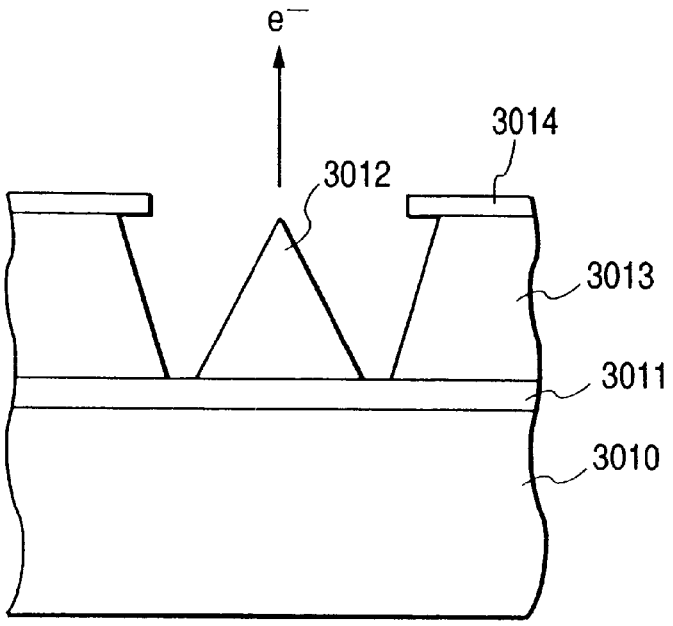
FIG. 20 PRIOR ART
FIG. 20 is a schematic cross sectional view of a known FE-type device.
Figure 21:
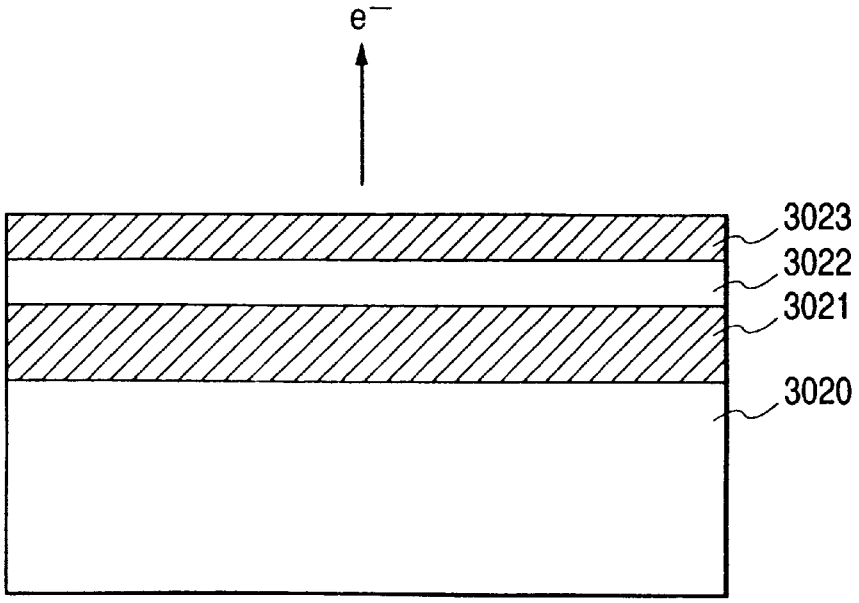
FIG. 21 PRIOR ART
FIG. 21 is a schematic cross sectional view of a known MIM-type device.
Figure 22:
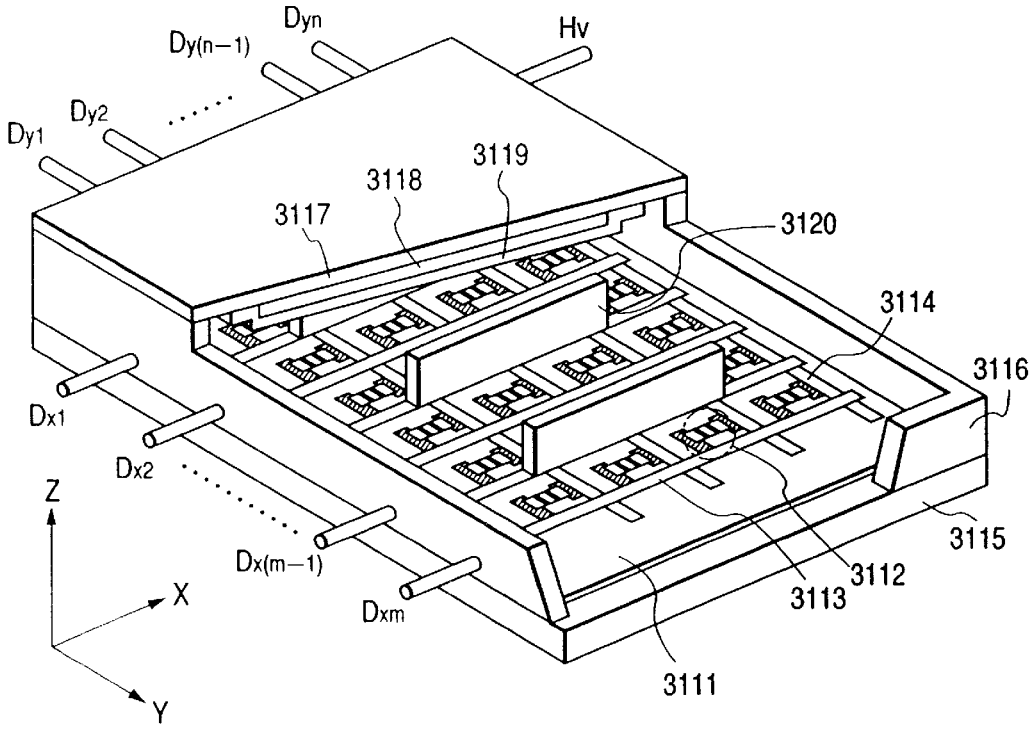
FIG. 22 PRIOR ART
FIG. 22 is a schematic perspective view of an image-forming apparatus, showing the inside by partially cutting away the display panel.

FIG. 18 is a schematic cross sectional view taken along lines 6—6 in FIG. 1 and the reference numbers same as those of FIG. 6 are used there. This embodiment differs from Embodiment 1 of FIG. 6 in that a high resistance film 11 is formed on the entire surface of the insulating member 1 and the low resistance layer 21 that is otherwise exposed to ambient air and, unlike Embodiment 2, the interface of the low resistance layer 21 and the bonding agent 1041 (the side of the low resistance layer that faces the accelerating electrode or the electron source) is also coated by the high resistance film 11.

This arrangement provides an advantage that the bottom surface of the low resistance layer 21 does not have to be masked when forming a film on the spacer 1020 by sputtering or dipping so that the film forming process can be simplified significantly.

While the abutting surfaces of this arrangement may provide a problem of electric connection, the inventors of the present invention have proved in experiments that a thickness between 50 nm and 500 nm is acceptable for a high resistance film 11. It may be safe to assume that a thin film with such a thickness (of less than 500 nm) will partly destructed at the abutting surfaces to establish electric connection.

Thus, sufficiently reducing the film thickness would establish a suitable electrical connection through a partial destruction of the abutting surfaces. While, without such partial destruction of the abutting surfaces, a contact resistance between the low resistance film and the electron source (i.e., the wiring thereof) or between the low resistance film and the accerleration electrode is a resistance in a thickness direction of the high resistance film. Accordingly, when the thickness of the high resistance film is not greater than 100 $\mu$m, desirably 1 $\mu$m, the electrical connection can be established.

The present invention provides a technique for overcoming the problems that arise in an electron source having a member arranged between it and a control electrode. Therefore, the technique of the present invention can effectively prevent electric discharges during the operation of displaying images to display fine images.

Particularly, when a high voltage is applied between the substrate and the flourescent film of a display panel, a concentrated electric field can appear in the interface of an electrocoductive film and an antistatic film to generate electric discharges. Such electric discharges occur abruptly to disturb the image being displayed and also degrade the cold cathode devices located nearby. However, according to the invention, a low resistance layer is arranged not only on the antistatic film but also on the bonding interface of the spacer and the low potential substrate and that of the spacer and the high potential metal back and additionally, the low resistance film is at least partly covered by a high resistance film to ensure fine images to be displayed reliably. Additionally, according to the invention, spacers to be used for an electron source apparatus can be manufactured with ease.

What is claimed is:

1. An electron beam apparatus comprising an electron source having electron beam emitting devices, an electrode for controlling electrons emitted from said electron source and members arranged between said electron source and said electrode, wherein said members have:

a high resistance film formed on a surface thereof; and at least a low resistance layer formed on the side facing said electrode or said electron source;

said high resistance film being electrically connected to either said electrode or said electron source by way of said low resistance layer, wherein said low resistance layer is arranged on the end face of said members facing either said electrode or said electron source and extending to the lateral sides thereof and the extended portion of said low resistance layer is covered by said high resistance film at least at the extreme ends thereof.

2. An electron beam apparatus according to claim 1, wherein said low resistance layer is covered by said high resistance film in a boundary area held in connection with said high resistance film.

3. An electron beam apparatus according to claim 1, wherein said low resistance layer is covered by said high resistance film in an area exposed to ambient air.

4. An electron beam apparatus according to claim 1, wherein said low resistance layer is entirely covered by said high resistance film.

5. An electron beam apparatus according to claim 1, wherein said members have said low resistance layer and said high resistance film sequentially formed in the mentioned order.

6. An electron beam apparatus according to claim 1, wherein said low resistance layer is covered by said high resistance film at least in part of the area exposed to ambient air.

7. An electron beam apparatus according to claim 1, wherein said electron source has a plurality of electron-emitting devices connected by wires and said members are electrically connected to said wires.

8. An electron beam apparatus according to claim 1, wherein said electron source has a plurality of electron-emitting devices connected to form a matrix-wiring arrangement by means of a plurality of row-directional wires and a plurality of comumn-directional wires electrically insulated from said plurality of row-directional wires.

9. An electron beam apparatus according to claim 1, wherein said electrode is an acceleration electrode for accelerating electrons emitted from said electron source.

10. An electron beam apparatus according to claim 1, wherein said electron-emitting devices are surface conduction electron-emitting devices.

11. An electron beam apparatus according to claim 1, wherein said members are spacers.

12. An electron beam apparatus according to claim 1, wherein said electron source has a plurality of electron-emitting devices.

13. An electron beam apparatus according to claim 1, wherein said high resistance film is electrically connected to either said electrode or said electron source by way of said low resistance layer.

14. An image-forming apparatus comprising an electron beam apparatus according to claim 1, wherein an image is formed by irradiating a target with electrons emitted from said electron-emitting devices.

15. An image-forming apparatus according to claim 14, wherein said target comprises fluorescent bodies.

16. An electron beam apparatus comprising an electron source having electron beam emitting devices, an electrode separated from said electron source and members arranged between said electron source and said electrode, wherein said members include:

a film arranged on a surface thereof and adapted to allow a minute electric current to flow therethrough; and an end electrode arranged at least at the end facing said electron source or said electrode, wherein said end electrode is arranged on the end face of said members facing either said electrode or said electron source and extending to the lateral sides thereof and the extended portion of said end electrode is covered by said film at least at the extreme ends thereof.

17. An electron beam apparatus according to claim 16, wherein said end electrode is covered by said film at least in the area connected to said film.

18. An electron beam apparatus according to claim 16, wherein said end electrode is covered by said film in an area exposed to ambient air.

19. An electron beam apparatus according to claim 16, wherein said end electrode is covered by said film in part of an area exposed to ambient air.

20. An electron beam apparatus according to claim 16, wherein said end electrode is entirely covered by said film.

21. An electron beam apparatus according to claim 16, wherein said members have said end electrode and said film sequentially formed in the mentioned order.

22. An electron beam apparatus according to claim 16, wherein said electron source has a plurality of electron-emitting devices connected by wires and said members are electrically connected to said wires.

23. An electron beam apparatus according to claim 16, wherein said electrode is an acceleration electrode for accelerating electrons emitted from said electron source.

24. An electron beam apparatus acccording to claim 16, wherein said electron-emitting devices are surface conduction electron-emitting devices.

25. An electron beam apparatus according to claim 16, wherein said members are spacers.

26. An electron beam apparatus according to claim 16, wherein said electron source has a plurality of electron-emitting devices.

27. An electron beam apparatus according to claim 16, wherein said electron source has a plurality of electron-emitting devices connected to form a matrix-wiring arrangement by means of a plurality of row-directional wires and a plurality of column-directional wires electrically insulated from said plurality of row-directional wires.

28. An image-forming apparatus comprising an electron beam apparatus according to claim 27, wherein an image is formed by irradiating a target with electrons emitted from said electron-emitting devices.

29. An image-forming apparatus according to claim 28, wherein said target comprises fluorescent bodies.

30. An electron beam apparatus comprising an electron source having electron beam emitting devices, and electrode for controlling electrons emitted from said electron source and members arranged between said electron source and said electrode, wherein said members have:

a high resistance film formed on a surface thereof; and at least a low resistance layer formed on the side facing said electrode or said electron source;

said high resistance film being electrically connected to either said electrode or said electron source by way of said low resistance layer, wherein said high resistance film may be arranged to cover said low resistance layer at least on the end face facing said electrode or said electron source.

31. An electron beam apparatus according to claim 30, wherein said low resistance layer is covered by said high resistance film in a boundary area held in connection with said high resistance film.

32. An electron beam apparatus according to claim 30, wherein said low resistance layer is covered by said high resistance film in an area exposed to ambient air.

33. An electron beam apparatus according to claim 30, wherein said low resistance layer is entirely covered by said high resistance film.

34. An electron beam apparatus according to claim 30, wherein said members have said low resistance layer and said high resistance film sequentially formed in the mentioned order.

35. An electron beam apparatus according to claim 30, wherein said low resistance layer is covered by said high resistance film at least in part of the area exposed to ambient air.

36. An electron beam apparatus according to claim 30, wherein said electron source has a plurality of electron-emitting devices connected by wires and said members are electrically connected to said wires.

37. An electron beam apparatus according to claim 30, wherein said electron source has a plurlaity of electron-emitting devices connected to form a matrix-wiring arrangement by means of a plurality of row-directional wires and a plurality of column-directional wires electrically insulated from said plurality of row-directional wires.

38. An electron beam apparatus according to claim 30, wherein said electrode is an acceleration electrode for accelerating electrons emitted from said electron source.

39. An electron beam apparatus according to claim 30, wherein said electron-emitting devices are surface conduction electron-emitting devices.

40. An electron beam apparatus according to claim 30, wherein said members are spacers.

41. An electron beam apparatus according to claim 30, wherein said electron source has a plurality of electron-emitting devices.

42. An electron beam apparatus according to claim 30, wherein said high resistance film is electrically connected to either said electrode or said electron source by way of said low resistance layer.

43. An image-forming apparatus comprising an electron beam apparatus according to claim 30, wherein an image is formed by irradiating a target with electrons emitted from said electron-emitting devices.

44. An image-forming apparatus according to claim 43, wherein said target comprises fluorescent bodies.

45. An electron beam apparatus comprising an electron source having electron beam emitting devices, an electrode separated from said electron source and members arranged between said electron source and said electrode, wherein said members include:

a film arranged on a surface thereof and adapted to allow a minute electric current to flow therethrough; and an end electrode arranged at least at the end facing said electron source or said electrode, wherein said film is arranged to cover said end electrode at least on the end face facing said electrode or said electron source.

46. An electron beam apparatus according to claim 45, wherein said end electrode is covered by said film at least in the area connected to said film.

47. An electron beam apparatus according to claim 45, wherein said end electrode is covered by said film in an area exposed to ambient air.

48. An electron beam apparatus according to claim 45, wherein said end electrode is covered by said film in part of an area exposed to ambient air.

49. An electron beam apparatus according to claim 45, wherein said end electrode is entirely covered by said film.

50. An electron beam apparatus according to claim 45, wherein said members have said end electrode and said film sequentially formed in the mentioned order.

51. An electron beam apparatus according to claim 45, wherein said electron source has a plurality of electron-emitting devices connected by wires and said members are electrically connected to said wires.

52. An electron beam apparatus according to claim 45, wherein said electrode is an acceleration electrode for accelerating electrons emitted from said electron source.

53. An electron beam apparatus according to claim 45, wherein said electron-emitting devices are surface conduction electron-emitting devices.

54. An electron beam apparatus according to claim 45, wherein said members are spacers.

55. An electron beam apparatus according to claim 45, wherein said electron source has a plurality of electron-emitting devices.

56. An electron beam apparatus according to claim 45, wherein said electron source has a plurality of electron-emitting devices connected to form a matrix-wiring arrangement by means of a plurality of row-directional wires and a plurality of column-directional wires electrically insulated from said plurality of row-directional wires.

57. An image-forming apparatus comprising an electron beam apparatus according to claim 56, wherein an image is formed by irradiating a target with electrons emitted from said electron-emitting devices.

58. An image-forming apparatus according to claim 57, wherein said target comprises fluorescent bodies.

* * * * *

UNITED STATES PATENT AND TRADEMARK OFFICE

CERTIFICATE OF CORRECTION

PATENT NO. : 6,441,544 B1
DATED : August 27, 2002
INVENTOR(S) : Yochi Ando et al.

It is certified that error appears in the above-identified patent and that said Letters Patent is hereby corrected as shown below:

Column 14,
Line 48, “and Pg—Ag” should read -- or Pd—Ag --.

Column 16,
Line 1, “has” should read -- have --.

Column 28,
Line 26, “Ebodiment 1.” should read -- Embodiment 1. --.

Column 30,
Line 12, “comumn-directional” should read -- column-directional --.

Column 31,
Line 21, “and” should read -- an --; and
Line 56, “plurlaity” should read -- plurality --.

Signed and Sealed this

Twenty-seventh Day of May, 2003

JAMES E. ROGAN
*Director of the United States Patent and Trademark Office*